US005651149A

United States Patent [19]

Garman

[11] Patent Number: 5,651,149

[45] Date of Patent: Jul. 29, 1997

[54] APPARATUS FOR MOVING DISABLED PERSONS

[75] Inventor: David Edmund Talbot Garman, Powys, United Kingdom

[73] Assignee: Mangar International Limited, United Kingdom

[21] Appl. No.: 537,717

[22] PCT Filed: Feb. 3, 1995

[86] PCT No.: PCT/GB95/00221

§ 371 Date: Oct. 11, 1995

§ 102(e) Date: Oct. 11, 1995

[87] PCT Pub. No.: WO95/21600

PCT Pub. Date: Aug. 17, 1995

[30] Foreign Application Priority Data

Feb. 11, 1994 [GB] United Kingdom ..... 9402656

[51] Int. Cl.[6] ..... A61G 7/10

[52] U.S. Cl. ..... 5/81.1 R; 5/87.1; 5/84.1; 5/81.1 HS; 414/921

[58] Field of Search ..... 5/81.1 R, 81.1 HS, 5/83.1, 84.1, 85.1, 86.1, 87.1, 88.1, 89.1; 414/924, 541

[56] References Cited

U.S. PATENT DOCUMENTS

| | | | |
|---|---|---|---|
| 953,962 | 4/1910 | Lane | 5/87.1 |
| 2,587,068 | 2/1952 | Sandors et al. . | |
| 2,665,932 | 1/1954 | Butler | 5/88.1 |
| 4,747,170 | 5/1988 | Knouse | 5/81.1 HS |
| 4,999,862 | 3/1991 | Hefty | 5/87.1 |
| 5,005,233 | 4/1991 | Toivio et al. | 5/87.1 |
| 5,333,333 | 8/1994 | Mah | 5/87.1 |
| 5,379,468 | 1/1995 | Cassidy et al. | 5/97.1 X |
| 5,406,658 | 4/1995 | Olkkonen et al. | 5/87.1 X |

FOREIGN PATENT DOCUMENTS

| | | | |
|---|---|---|---|
| 1170604 | 7/1994 | Canada | 5/87.1 |
| 2097250 | 11/1982 | United Kingdom . | |
| 2139487 | 11/1994 | United Kingdom . | |

*Primary Examiner*—Michael F. Trettel
*Attorney, Agent, or Firm*—Neil F. Markva

[57] ABSTRACT

Apparatus and method for transferring disabled persons horizontally on a slider (11) from a first supporting surface to an adjacent supporting surface by using a cable winch (10) to apply tension to a cable (15) to drag the slider (11) (and the person thereon) from one surface to the other. The cable and/or winch is/are relocatable to drag the slider substantially horizontally in the opposite direction. Either or both of the supporting surfaces may be on platforms (beds, seats etc) supported by lifting devices (39, 60, 63) and bridging means (42) may be provided on the platforms. The apparatus can be integrated into a bed, trolley, wheelchair or a medical, nursing or sanitary installation.

20 Claims, 21 Drawing Sheets

APPARATUS FOR MOVING DISABLED PERSONS

This invention concerns apparatus for moving disabled persons.

It is known to use a mechanical hoist to raise and lower a seat or sling on which a person is supported to raise that person; and to move the hoist to a support so that the person can be shifted from the seat or sling onto that support.

Problems arise where such a person needs to be lifted in confined spaces which preclude access for such hoists because of their bulk and operational space requirements.

Furthermore, such hoists are of only partial assistance in moving such persons because they have to be manhandled onto and off the hoist's seats or slings. Such manhandling often gives rise to further problems e.g. pain or even injury to such persons, and excessive efforts by the operatives can cause them injuries.

In particular, such hoists have a selection of slings for different functions to maintain the safety and comfort of the occupant. Choosing the correct one and loading a person onto the hoist can cause anxiety to the occupant and to the operator. Hoists require under-furniture clearance which necessitates the use of small castors. This in turn leads to difficulty in maneuvering the loaded hoist. The occupant has to be restrained from swaying when moving. Essentially this type of equipment is designed solely for use by persons having no ability to assist in their own transfer.

The present invention seeks to reduce said problems.

The invention provides a method of transferring a disabled person from a first supporting surface to a second supporting surface comprising the steps of:

(a) locating a winch cable to extend across the second supporting surface to the first supporting surface, and inserting a flexible slider between said person and the first supporting surface;

(b) connecting said winch cable to one margin of the slider;

(c) actuating a winch to apply tension to the cable to drag the slider from the first to the second surface carrying said person therewith; and, optionally, (d) removing the slider from beneath said person.

The method preferably includes the step of bringing said surfaces into a relationship wherein the second surface is level with or slightly lower than the first surface.

The winch cable may subsequently be relocated to extend across the first supporting surface to the second supporting surface and be re-attached to the opposite margin of the slider so that actuation of the winch applies tension to the cable to drag the slider back onto the first supporting surface.

The invention includes apparatus constructed for use in performing said method, and which apparatus includes a cable winch, a slider and connector means to connect the cable to the slider, together with a support comprising a platform which provides a supporting surface and bridging means to bridge the gap between the first and second supporting surfaces; and including a mounting for locating the cable winch in relation to the platform.

For lifting and moving disabled persons in accordance with the invention, the apparatus preferably further comprises platform lifting means mounted on the support to raise and lower the platform, the cable winch being directly or indirectly connected to the platform for drawing the cable of the winch across the platform.

In embodiments of the apparatus the apparatus further includes a mast assembly which comprises a mast, a jib, and a mounting for locating the mast assembly for movement relative to the support so that the jib is movable to alongside the support, the winch being operable to retract the cable to a free end of the jib for transferring persons to and/or from the support in accordance with the invention.

The apparatus of the present invention more particularly comprises a cable winch secured, or adapted to be secured by a mounting, to or adjacent to a support so that a cable of the winch can be extended across a platform provided on the support, a slider which can be inserted between a disabled person and a surface on which said person is supported, and a connector to releasably connect an end of the slider to the cable so that operation of the winch drags said slider across said surface and onto said platform to transfer the person from the surface to the platform.

The mounting in one embodiment is attached or attachable on or to a handrail or structural member alongside or adjacent the support located in a medical, nursing or sanitary installation.

In other embodiments the support is in the form of a bed, wheelchair, stretcher or trolley, and the platform provides a supporting surface on which a person can sit, recline or lie; and wherein the winch is releasably connected to the platform by the mounting.

The winch is preferably carried by a mast assembly which is pivotally connected to said platform, which mast assembly preferably comprises a mast and a jib extending from a free end of the mast, and the cable is extendable from and retractable to a free end of the jib.

The winch may be mounted on the jib, or the winch may be mounted on the mast and the free end of the jib may be provided with cable guide means.

Either or both of the mast and the jib may be extendable.

The winch is preferably electrically driven, remotely controllable, and operated from a low voltage DC supply. The supply is preferably provided by a portable, rechargeable unit.

The flexible slider preferably has a beam along at least one margin to receive the drag force applied by the connector and to distribute said force to said margin.

The undersurface of the slider preferably has a lower co-efficient of friction than the upper surface.

The apparatus preferably further includes lifting means lifting means to raise and lower the platform.

The lifting means is preferably operated from the or a low voltage, portable, rechargeable unit, which is The lifting means is preferably operated from the or a low voltage, portable, rechargeable unit, which is preferably stowed in or carried by the apparatus.

The unit may include or power a compressor, and the lifting means is preferably powered by compressed air from the compressor.

The winch may be releasably secured to a frame part of the platform by a mounting which is adapted to enable the winch to be secured alternatively to a frame part of a hospital bed, stretcher or trolley, or to a handrail or support frame.

One embodiment of the apparatus for moving disabled persons is in the form of a wheelchair comprising a seat, a slider, a powered lifting means for raising and lowering the seat, a powered leg support device attachable to a front end of the seat, a powered lifting device separable from the wheelchair, a cable winch, and means to connect the cable of the winch to the slider, and a remotely control unit to selectively energise said lifting means, the leg support device, the lifting device and said winch for use in raising a person on the lifting device and then drawing the raised person on the slider from the lifting device onto the seat by means of the cable winch.

The lifting means, leg support device and lifting device are preferably pneumatically operated.

The lifting means and the lifting device may each comprise a plurality of pneumatically inflatable bags secured on on top of the other, each bag including internal connection means to limit separation of an upper panel from a lower panel of the bag.

The apparatus preferably further includes a pressure sensitive control unit constructed and arranged to receive a single compressed air supply and to distribute the compressed air sequentially to a plurality of outlets which, in use, are connected to the bags, so that, starting with the lowermost, each bag is inflated in turn to a predetermined pressure and is pneumatically isolated from the supply before inflation of the next above bag commences.

The lifting device, when deflated, is preferably sufficiently flexible and thin to be slid or eased under a disabled person; and preferably provides sufficient lift to raise the uppermost surface of the device approximately to the level of the seat in its lowermost condition.

The seat or platform is preferably provided with bridging means, e.g. flank panels, pivotally mounted on the sides of the seat or platform. The seat may also have a backrest and optionally armrests pivotally mounted on the backrest.

Guide means for guiding the cable is preferably provided on or in the backrest and the flank panels.

The apparatus preferably comprises a mast assembly which includes a mast mounted for arcuate movement on a rear part of the seat or platform to carry a jib which, with the mast in an upright condition, projects over the seat or platform.

The mast is preferably movable to shift the jib to either side of the seat or platform, and is preferably extendable and retractable to vary the spacing between the jib and the platform or seat.

The winch may be mounted on the mast or the jib, or mountable on alternative mountings provided on both the jib and the platform. The mast and jib may be provided with cable guide means. The mast is preferably driven to move pivotally by a low voltage, remotely controllable motor. A further motor may be provided to extend and retract the mast.

In another embodiment the apparatus for moving disabled persons is in the form of a bed or trolley comprising a platform, a winch mounted on a mast assembly pivotally mounted at one end of the platform, the mast assembly comprising a jib mounted on a free end of a mast to extend towards the other end of the platform, said winch having a cable which is extendable from and retractable to and a free end of the jib; said mast assembly being pivotally movable to swing the jib from one side of the platform to the other side of the platform.

The backrest and/or a chassis of the wheelchair preferably provides stowage, e.g. for the or a slider and ancillary devices.

In accordance with the present invention a bath or bath installation incorporates apparatus for moving disabled persons which comprises a slider, an elevating support located in the bath, a cable winch mounted on or adjacent to the bath, and guide means to guide a winch cable from the winch to alongside the elevating support, connector means to connect the cable to the slider so that in use the winch can be operated to draw the slider with a person thereon approximately in the plane of the support from outside the bath onto the support after the support has been raised to approximately the level of a brim of the bath.

The invention will be described further, by way of example, with reference to the accompanying diagrammatic drawings wherein.

Figure 1:
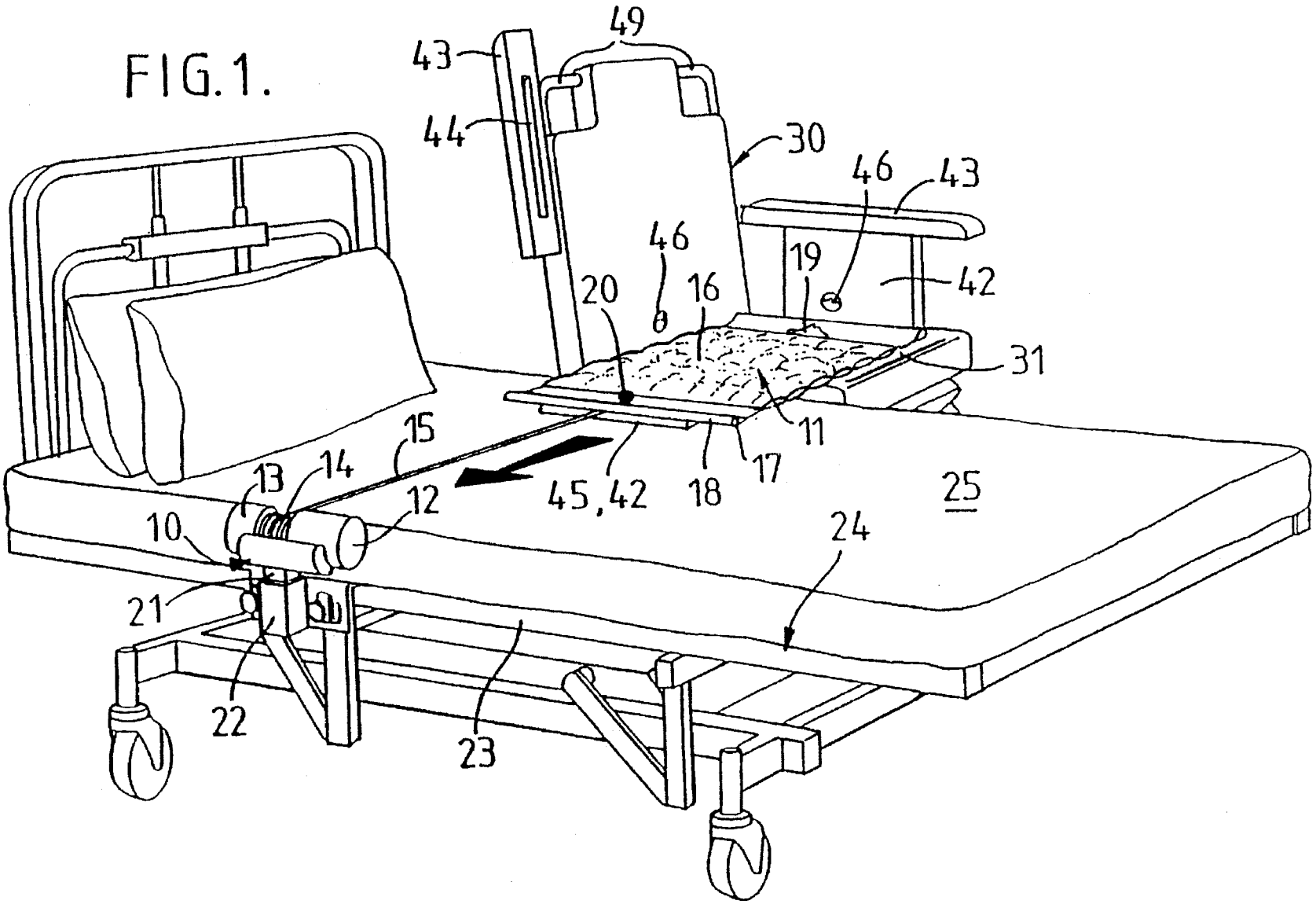
FIGS. 1 and 2 are perspective views of a first embodiment of apparatus of the invention showing the arrangement of the apparatus for use in transferring a person to a framed bed from a wheelchair and vice versa.
Figure 2:
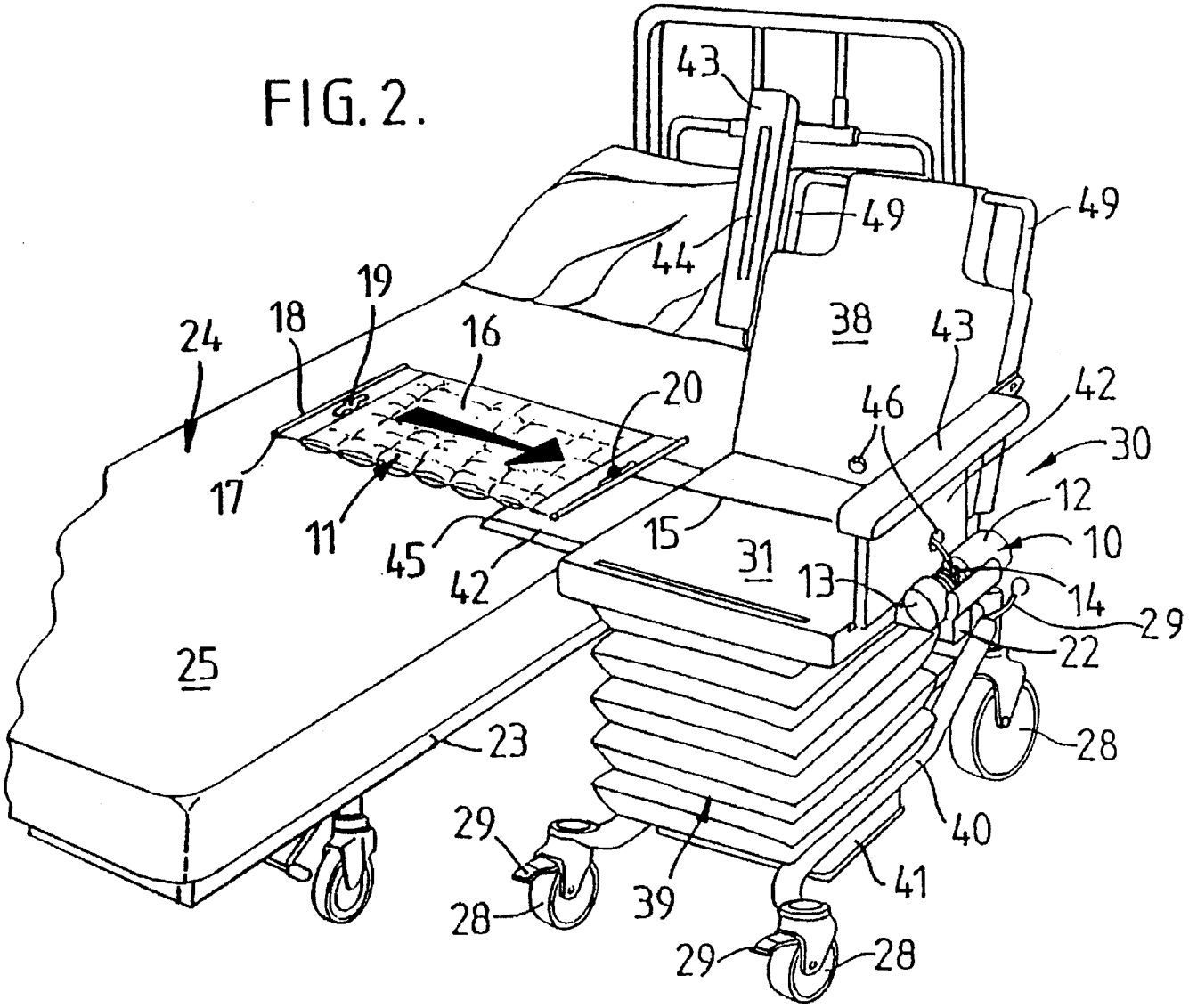

Referring to FIGS. 1 and 2, the first embodiment of the apparatus includes a cable winch 10 and a slider 11. The winch has a British Standard SELV motor, e.g. a 12 volt DC motor 12 to drive, via a gear 13, a drum 14 on which is wound its cable 15. The gear 13 includes a manually or remotely actuable release mechanism (not shown) to permit cable to be unwound manually from the drum, or the winch may be reversible to unwind cable from the drum.

The slider 11 includes a flexible panel 16 (preferably padded or inflatable to form a thin cushion) having a beam 17 in a pocket 18 at each end or each side. Adjacent a mid-part of each beam there is a keyhole or other shaped opening 19 through which a connector 20, such as a knob on one end of the cable, may be inserted so as to be trapped against the beam.

The winch 10 has a post 21 which is insertable into socket mountings 22 located on supports, such as, in this example, on each side of a frame 23 of a bed 24, and at the rear and at each side of a seat 31 of a wheelchair 30. However, instead of providing fixed mountings on each support unit (such as a bed, chair, stretcher, trolley or the like providing a platform having a surface on which a person may be supported e.g. may lie, recline or sit), the winch may have a G-clamp type of mounting arranged to clamp onto (to secure the winch to) any rigid bar, tube or angle frame member of the platform or a frame or chassis of such a support.

In use, the winch and slider are arranged so that the cable extends across the platform of a second support unit (the mattress 25 in FIG. 1 and the seat 31 in FIG. 2) and the slider is disposed between the person to be moved and the platform of the first support unit (e.g. the seat 31 in FIG. 1), the cable is connected to the end or side of the slider proximal to the second unit, and the winch is driven to drag the slider onto the platform of the second support unit. The person being transferred does not have to be lifted or shifted manually, merely given gentle support for stability and reassurance if needed.

The example of slider shown is intended to be sat on by the person being moved. Longer versions of the slider with lateral beams may be employed for shifting a person in a prone condition between elongate support units such as beds, trolleys, stretchers or operating tables, as indicated in broken lines in FIG. 9A.

To facilitate sliding movement of the slider 11, the undersurface has a much lower co-efficient of friction than the upper surface.

Although in the example shown the slider has pockets 18 at each end, further pockets may be provided along each side to receive lateral beams for supporting the panel in those instances where the slider has to traverse a significant gap between support units. Alternatively, the slider may be pneumatically inflatable so as to have sufficient beam strength to bridge significant gaps.

The beams are preferably removable to facilitate both removal of the slider from beneath a person, and the laundering of the panel.

Figure 4:
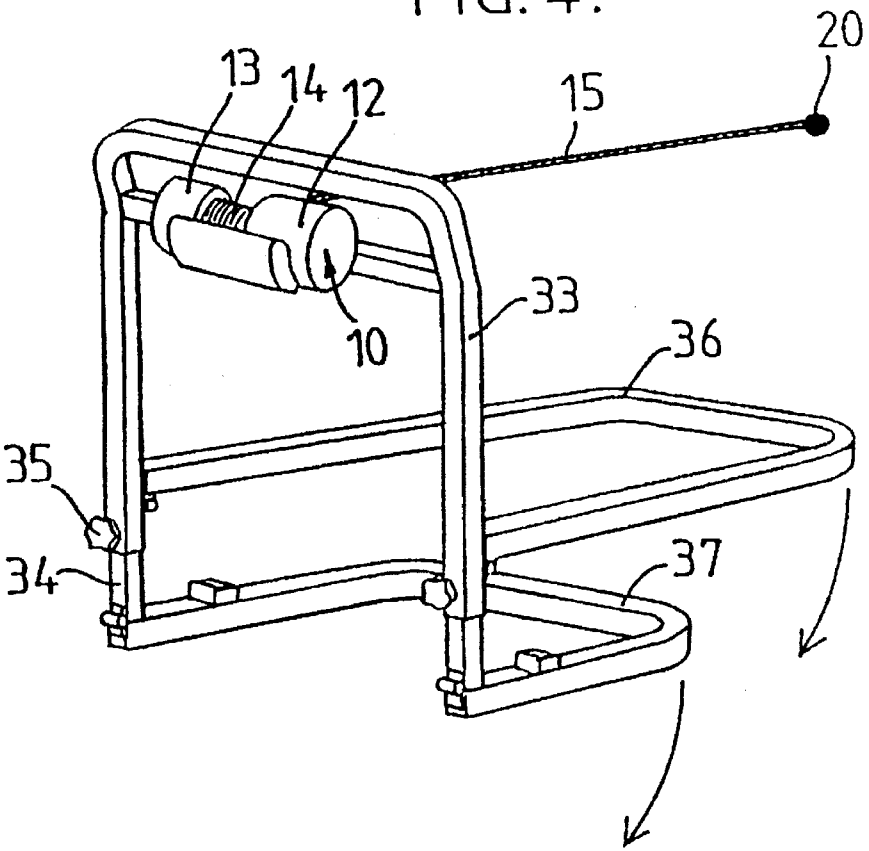
FIGS. 3 and 4 show a frame assembly providing a mounting of the apparatus for use on a frameless bed.
Figure 3:
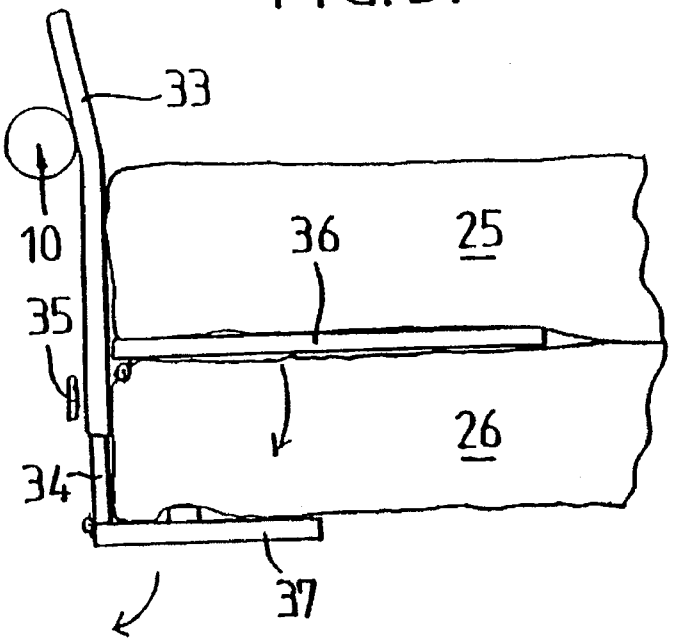

For use of the apparatus on support units lacking any exposed rigid frame and in which the platform is resilient, usually divan beds having a mattress platform, the apparatus includes the frame assembly 32 shown in FIGS. 3 and 4, which has a rear portion 33 on which the winch is mounted and in which a lower portion 34 is telescopically held by clamp bolts 35. An upper portion 36 lies under the mattress 25 to engage a divan or base 26, and a base portion 37 engages under the divan or base 26. The divan or base 26 is clamped between the upper and lower portions 36 and 37. The portions 36 and 37 are respectively pivotally connected to the portions 33 and 34 so that the assembly can be collapsed for storage.

Referring to FIGS. 1 and 2 and 5 to 13, in both embodiments, the apparatus includes the wheelchair 30 or a wheelchair 30A in which the seat 31, together with a backrest 38, is supported on lifting means 39 in the form of an internally mechanically stabilized pneumatically powered bellows. The base of the lifting means 39 is located on a wheeled chassis 40, which chassis provides stowage for an underslung electrical power supply and air compressor unit 41. The chassis has front and rear castor wheels 28 provided with brakes 29.

Each side of the seat 31 has bridging means, in the form of a flank panel 42, detachably and pivotally connected thereto, and each side of the backrest has an armrest 43 detachably and pivotally connected thereto. The underside of each armrest has a slot 44 therein to receive the free end 45 of the flank panel at that side of the wheelchair. During transfer, the armrest proximal to the bed is swung up and rearwards to alongside the backrest to serve as a transverse extension of the latter, and the flank panel is swung down to bridge between the seat and the mattress 25.

The wheelchair is provided with guide means in the form of cable guiding ports 46 in the centres of portions of the flank panels and backrest generally just above a seat level.

The rear of the backrest carries stowage (such as a bin, trough or rack) 47 to receive parts of the apparatus and ancillary devices.

In the first embodiment the backrest 38 is detachable from the seat 31 to allow four way access to the seat.

In the second embodiment (FIGS. 5, 6 and 7) the wheelchair 30A has a mast and jib assembly or structure 50 mounted on a raised rear frame extension 48 of the seat, and the backrest 38 has a frame (not shown except for parts 49 exposed to form handles) which is fixed to the frame of the seat.

The structure 50 enables a single mounting 51 to be provided on the structure to secure the winch 10, and gives much greater freedom for moving a person in conditions wherein a support unit is disposed so that access to one side thereof is precluded, e.g. where a bed is disposed alongside a wall, or where the support unit is a bathlift in a bath against a wall.

The structure 50 comprises a mast 52 mounted for moving about an elevated central fore and aft axis on the seat frame extension 48 to the rear of an arcuate rack 53 centered on said axis and fixed to the extension 48; a worm 54 which has a drive motor 27 and is mounted on the mast to engage the rack 53, and a jib 55 forwardly cantilevered from the upper end of the mast. The structure is provided with cable guide means, such as pulley wheels 56, so that the cable 15 runs from the winch up the mast and along or within the jib to the free end of the jib.

Figure 10:
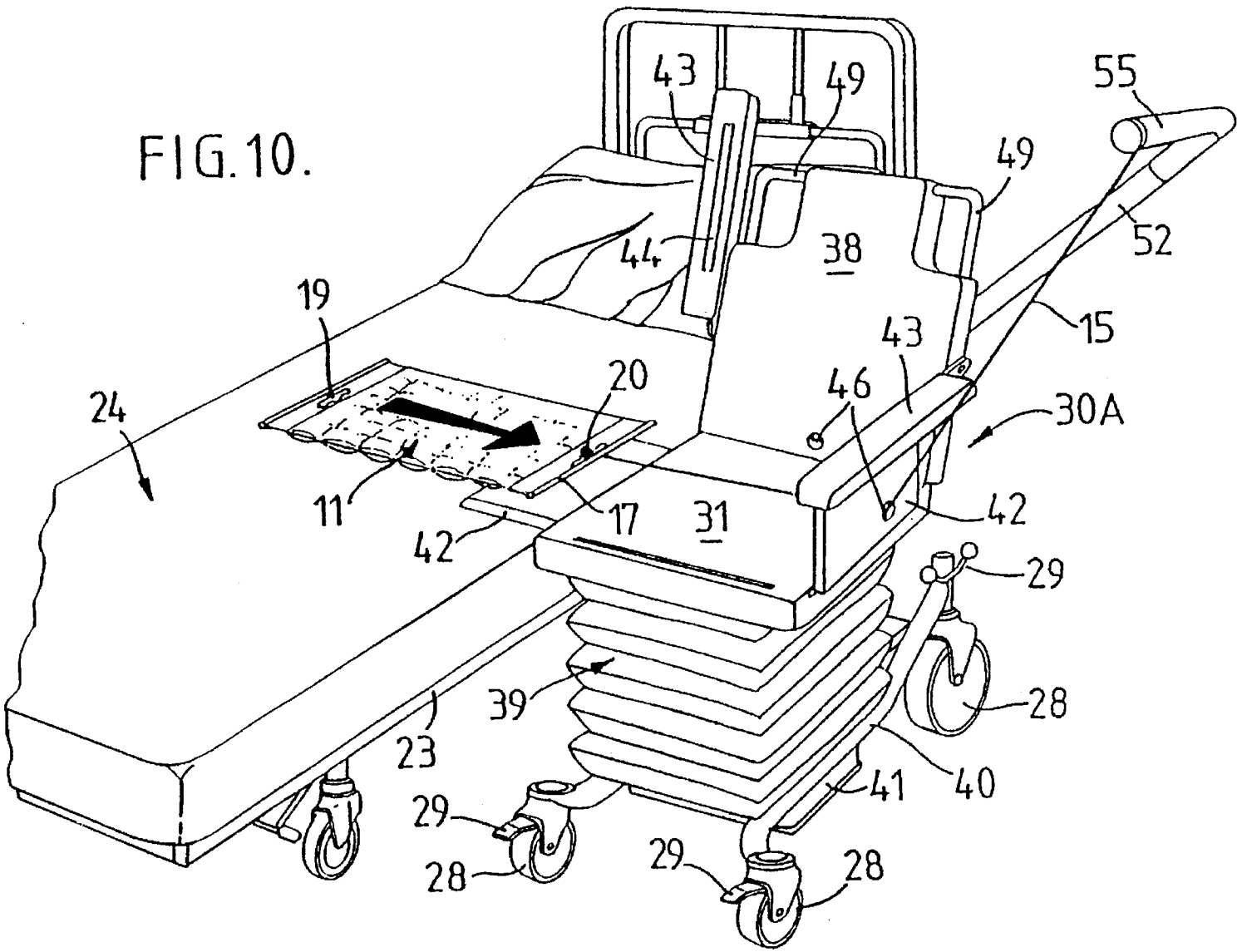
FIG. 10 is a view similar to FIG. 8 showing the arrangement for transferring a person from the bed to the wheelchair.

In use for transferring a person to or from the bed 24, the wheelchair 30A is brought to abut one side of the bed and the seat 31 is raised or lowered by means of the lifting means 39 until is is approximately level with the top of the mattress 2fi, before the armrest 43 and flank panel 41 proximal thereto are swung, respectively up and down, to provide clear access between the seat and the bed. For transferring a person from the seat to the bed, the worm 54 is then driven to swing the mast down until it overlies the bed and locates the jib 55 at the other side of the bed, remote from the wheelchair. The release mechanism of the gear 13 is actuated and sufficient cable 15 is drawn from the winch and across the bed to enable the connector to be engaged with the slider. These operations may be performed before the armrest and flank panel are moved up and down. Thereafter the winch is operated to draw the slider 11 (in the direction arrowed in FIGS. 8 and 9) from the seat onto the bed. For transferring a person in the reverse direction, the above procedure is modified in that the worm 54 is driven in the reverse direction until the jib is located to the side of the wheelchair remote from the bed, and the cable 15 is run through the port 46 in the flank panel at that side and across the seat before being connected to the slider, as shown in FIG. 10.

From FIGS. 5 and 8 to 10, it can be seen that the cable leaves or approaches the slider generally in a plane which passes through the ports 46 in the flank panels and backrest, irrespective of the angular position of the mast.

Figure 11:
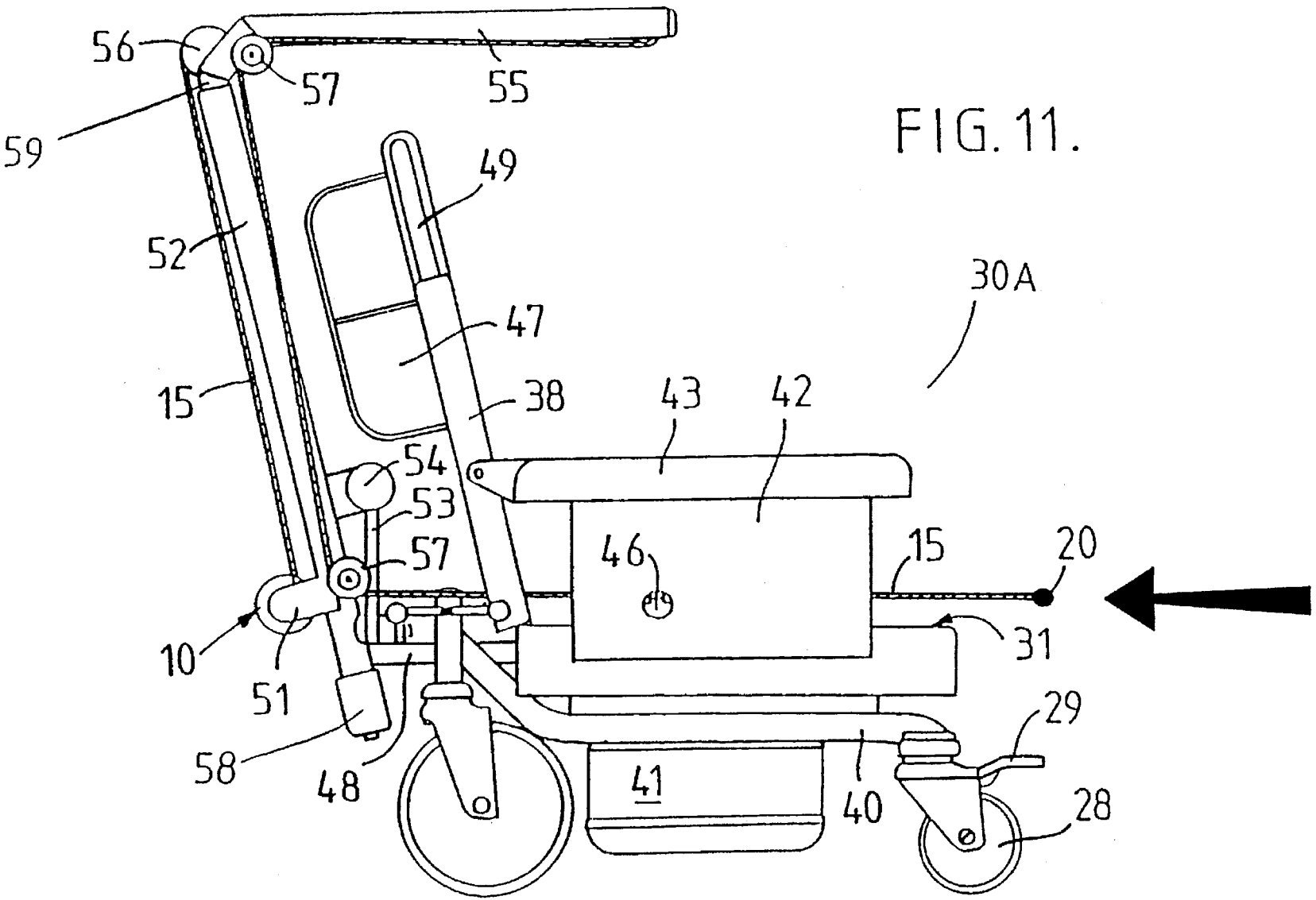
FIG. 11 shows the arrangement of the wheelchair of the second embodiment for drawing a person rearwardly onto the wheelchair.

To enable a person to be drawn rearwards into the wheelchair, e.g. from a stool or lifting device (not shown in FIG. 11), the wheelchair 30A has supplementary guide pulleys 57 mounted externally at the junction of the mast and jib and on one side of the mast level with the port 46 in the backrest so that, as shown in FIG. 11, the cable 15 can be run back and down from the free end of the jib, and forwards from the mast through said port and across the seat to the front of the wheelchair. (In the first embodiment, the winch 10 can be secured on a mounting to the rear of the seat so that the cable 15 can be run forwards, and straight through said port if the backrest is in place).

Figure 5:
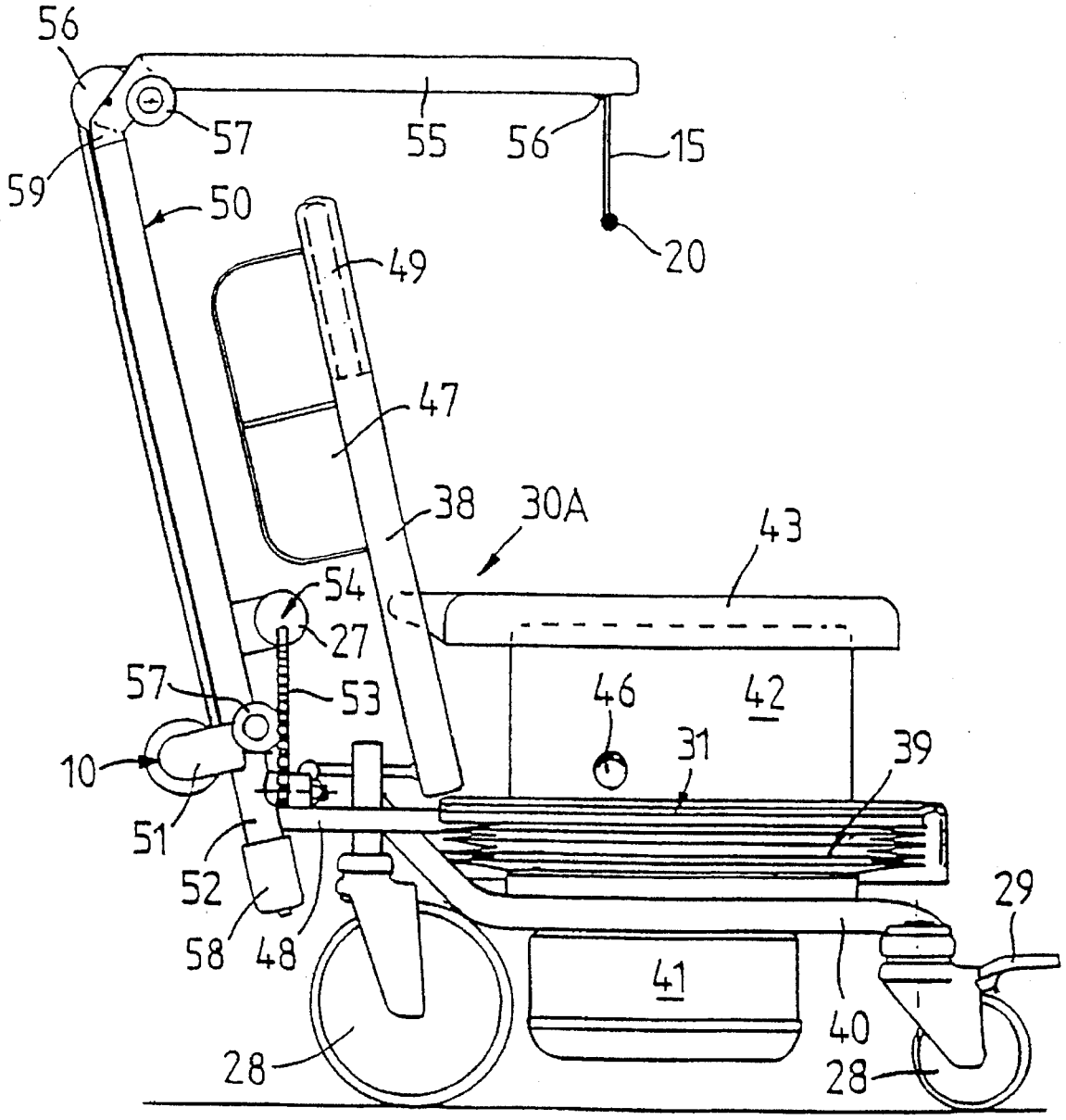
FIGS. 5, 6 and 7 show a second embodiment of the apparatus in the form of a wheelchair in side, front and rear elevation respectively.
Figure 6:
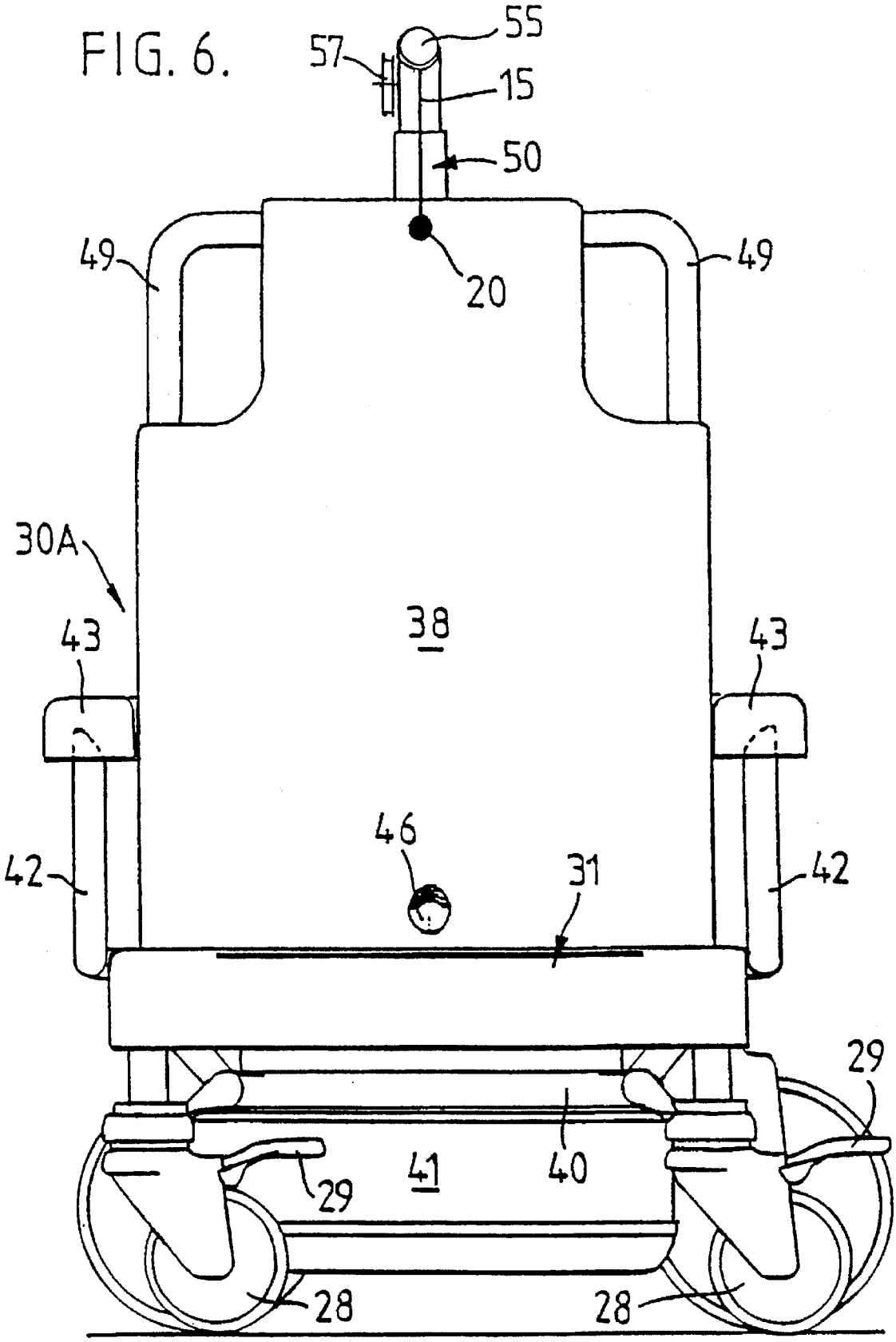

To enable the jib 55 to be moved towards and away from the seat 31 for varying the headroom over the seat and to span beds, trolleys or baths of different widths, the mast 52 is of telescopic form and has a mast extension motor 58 at its lower end to move an inner part 59 which carries the jib 55, as shown in FIGS. 5 and 11.

The apparatus preferably includes auxiliary lifting devices. For example, a pneumatically powered leg lifting and supporting device 60 is shown attached to the front of the seat in FIG. 9. This device 60 can be inflated by the unit 41 via a hose connection 97 (shown in FIG. 9) from a deflated condition, in which a cushion panel 61 hangs in front of the wheelchair, to a condition in which the panel 61 projects forwards level with the seat to lift and support the persons leg or legs during transfer, and during conveyance in the wheelchair. The device 60 can be removed and stowed in the storage 47.

Figure 9:
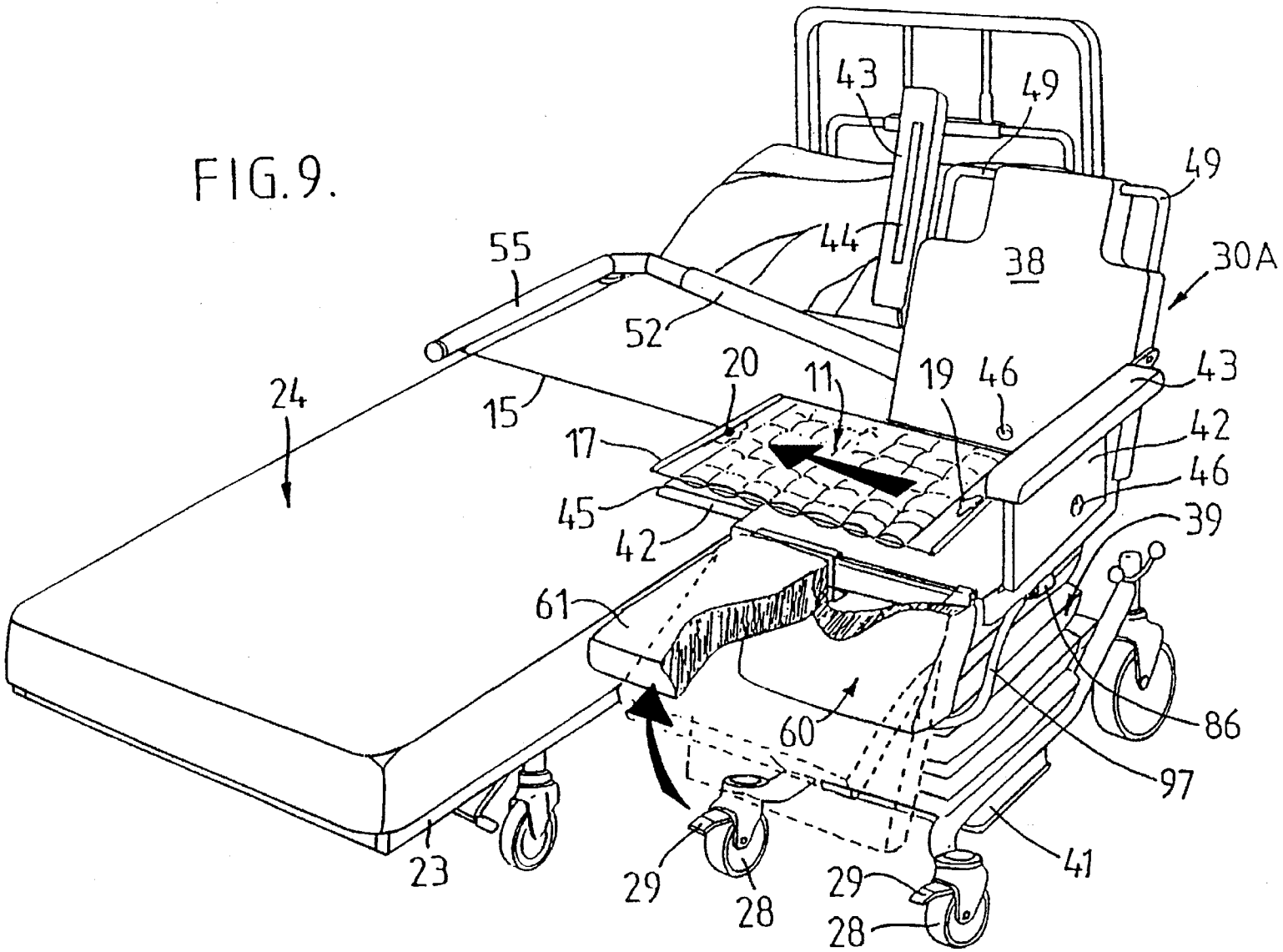
Figure 9A:
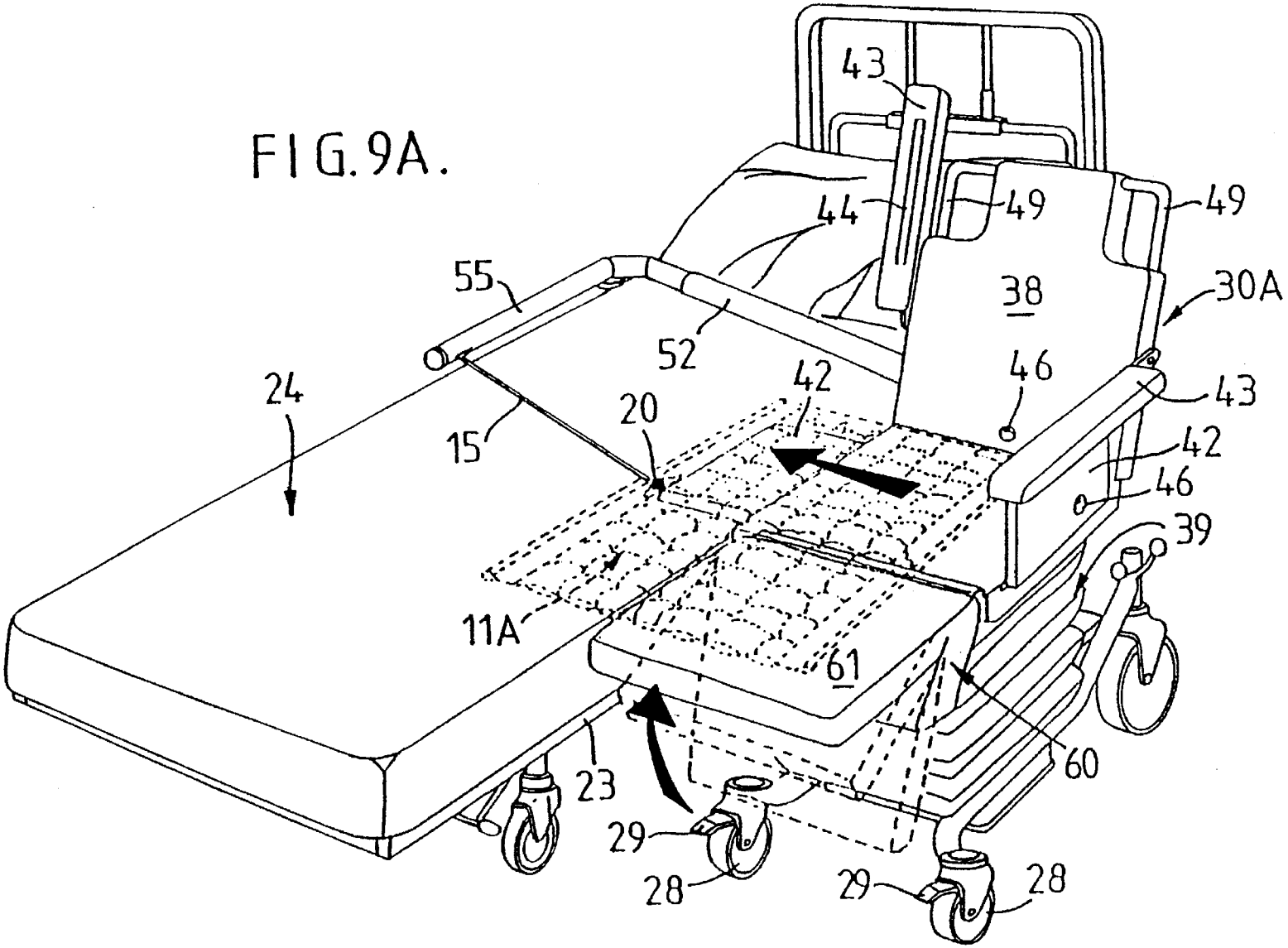

The device 60 is particularly useful for supporting a person so that the person's legs are not bent, and for such persons the larger slider 11A indicated in broken lines in FIG. 9A is preferably employed.

Figure 12:
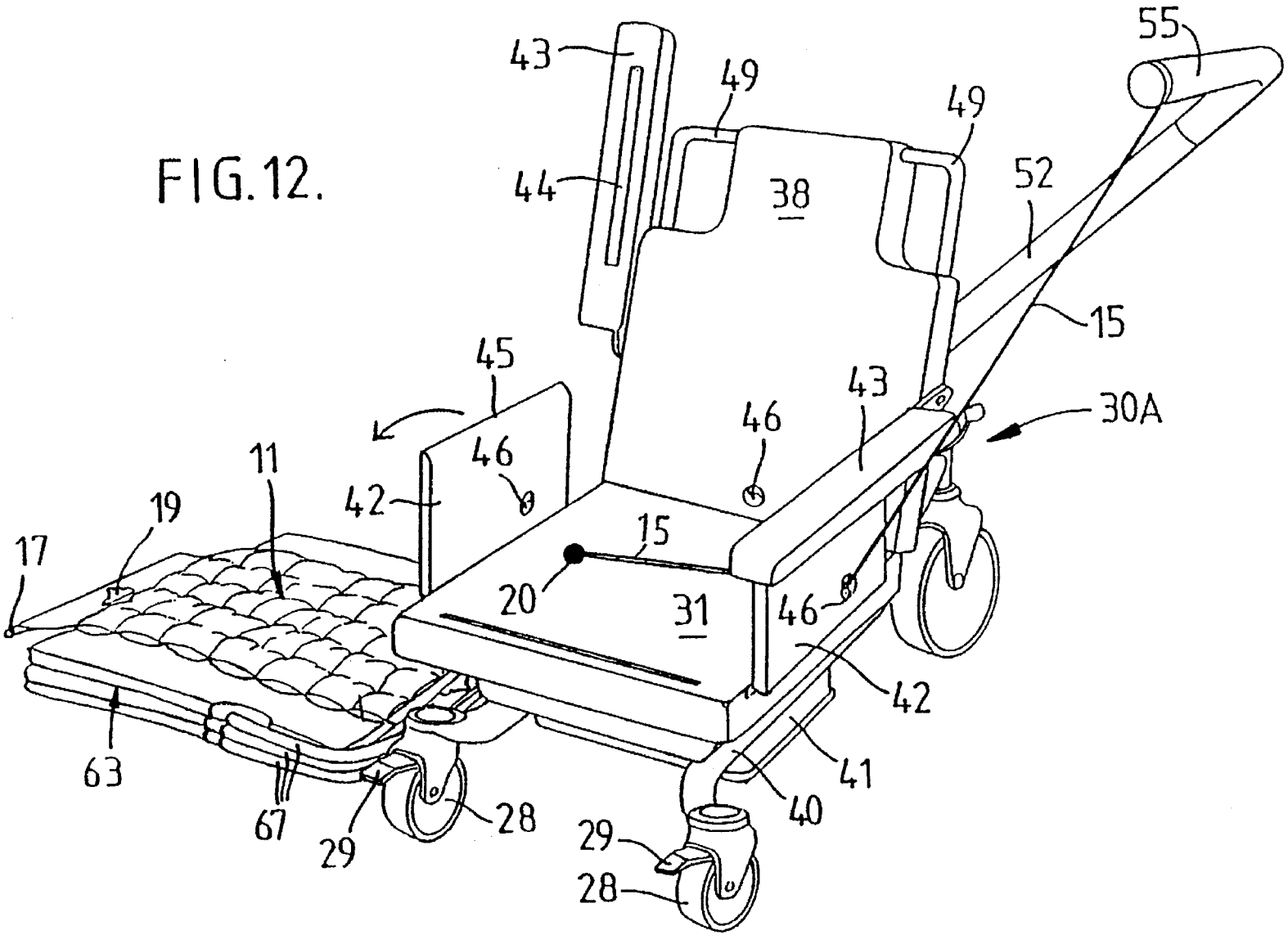
FIGS. 12 and 13 show the arrangement of the second embodiment together with an auxiliary lifting device, in two stages, for lifting a person from a floor and transferring the person to the wheelchair.
Figure 13:
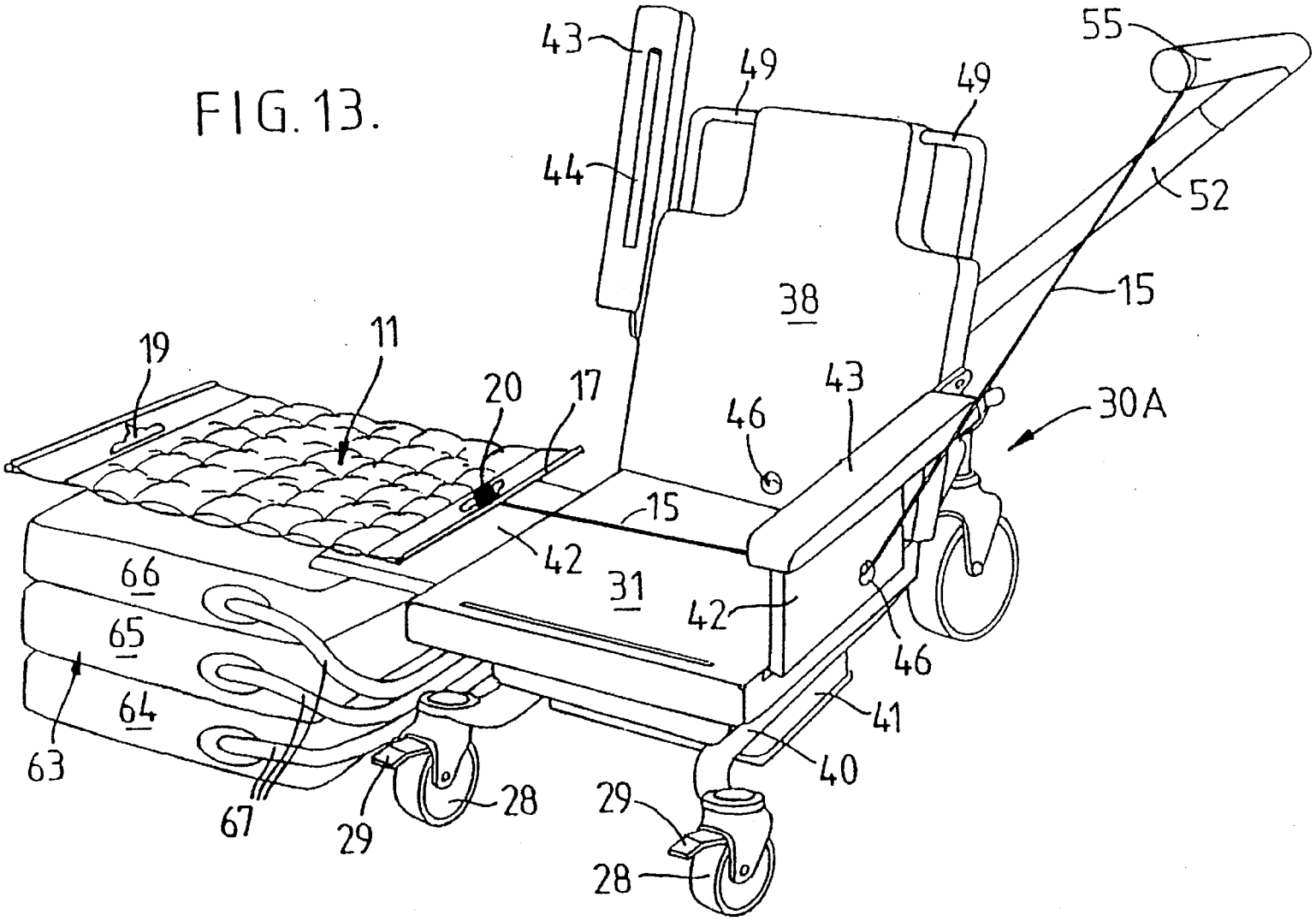
Figure 14:
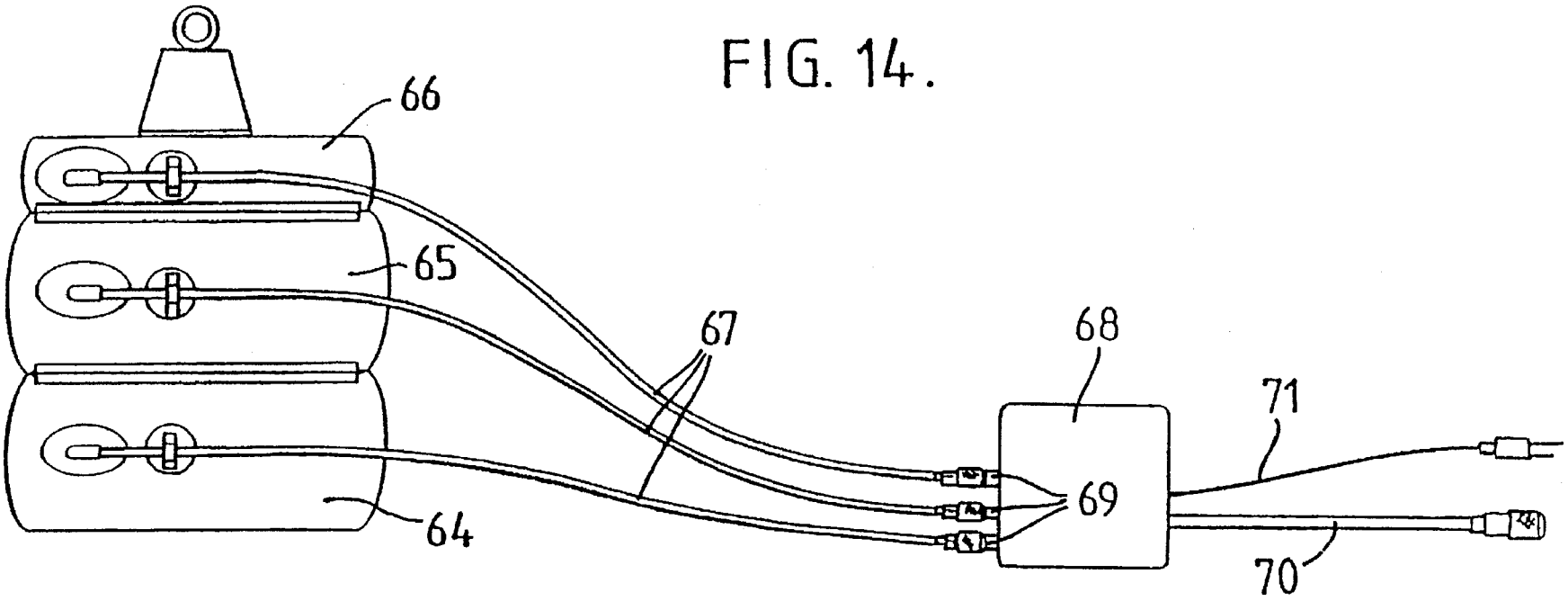
FIG. 14 shows an auxiliary control device in conjunction with the auxiliary lifting device.

An auxiliary lifting device 63 is shown in FIGS. 12 to 14, which comprises three superimposed bags 64, 65 and 66 secured together. Each bag contains internal flexible links, e.g. may be made of a "drop-thread" material, to connect the upper and lower panels internally, so as to keep them parallel by limiting the vertical separation thereof when the bag is inflated; and each bag is provided with a respective inflation hose 67. The device 63 is, in this embodiment, pneumatically inflated via a pressure sensitive control unit 68 (FIG. 14) which is arranged so that the bags are inflated sequentially and automatically when it is energised electrically and supplied with compressed air as hereinafter described.

The bags are dimensioned so that, when fully inflated, the overall height of the device 63 is slightly greater than the height of the seat 31 in its lowermost condition. The device 63 when deflated is thin, flexible and can be folded or rolled up and stowed in the storage 47 together with the control unit 68.

Referring to FIG. 12, the device 63 is intended to be inserted, together with the slider 11, under a person who is unable to get up from a floor. Insertion may well only require the person to be rolled or to be rocked so that the person's hips are raised slightly, without requiring the person to be lifted bodily. If required a further slider 11 may be interposed between the device 63 and the floor. When the person is seated on the device 63, the wheelchair 30A (or 30) is brought alongside (or the person and device are slid on the further slider to alongside the wheelchair), the proximal armrest is raised to release the flank panel (FIG. 12). The device 63 is inflated and prior to or during inflation the flank panel is inserted between the device and the slider, so as to bridge the space between the seat and the device as shown in FIG. 13. The cable 15 is then run across the seat from the other side and connected to the slider before the winch is actuated to draw the slider (and person thereon) onto the lowered seat.

Figure 15:
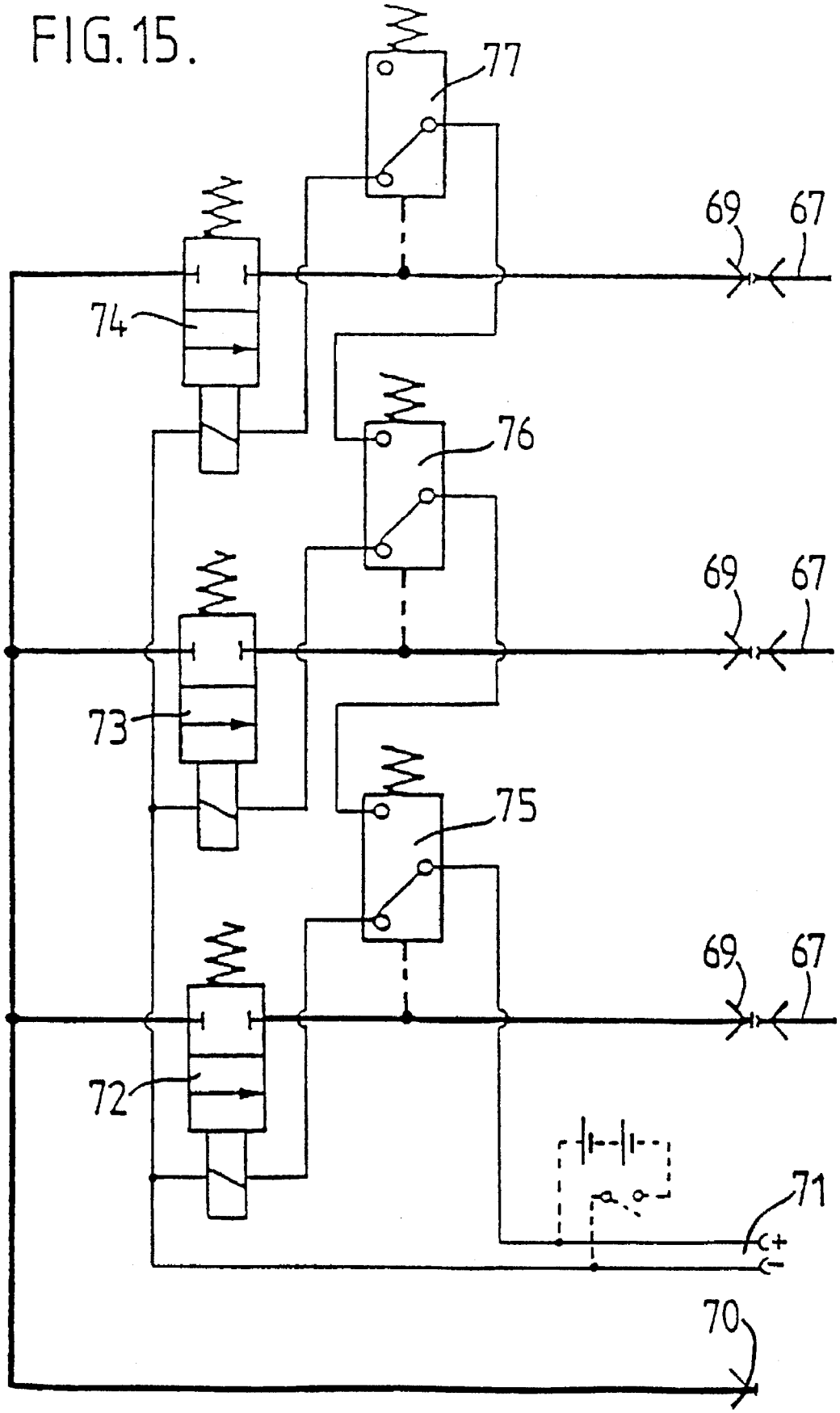
FIG. 15 is a schematic pneumatic/electrical diagram of the control device.

Referring to FIGS. 14 and 15, the control unit 68 provides connections 69 for the three hoses 67, and has an input hose 70 and electrical lead 71 for connecting the unit to The power supply and compressor unit 41 to receive compressed air and an electrical supply. The unit 68 has internally three solenoid actuated valves 72, 73 and 74 and three pressure sensitive switching arrangements (represented in FIG. 15 as three pressure sensitive switches 75, 76 and 77). When pressure is first supplied to the unit and the latter is electrically energized, switch 75 energizes the valve 72 which opens to supply compressed air to the bottom bag 64, and valves 73 and 74 remain closed. When the bag 64 is inflated to a predetermined pressure, switch 75 responds to de-energize (and thus close) valve 72 to energize switch 76 via which valve 73 is opened for inflating the middle bag 65 until it reaches a predetermined pressure at which the switch 76 responds to de-energize valve 73 and energize valve 74 via switch 77 for inflating the top bag 66. When the top bag is inflated to a predetermined pressure at which switch 77 responds to de-energise valve 74, inflation of the device is automatically halted, and the device is held inflated by the closed valves. The person operating the apparatus is free, during inflation of the device, to attend the person being lifted. The unit 68 may have an internal electrical power supply and energization switch as indicated in broken lines in FIG. 15.

The switching arrangements have considerable hysteresis, e.g. the said predetermined pressure is considerably higher than the pressure at which the switches revert to their normal (unpressurized) conditions. The device is deflatable by disconnection of the hoses 67 after the person has been transferred to the wheelchair (or other support).

Figure 16:
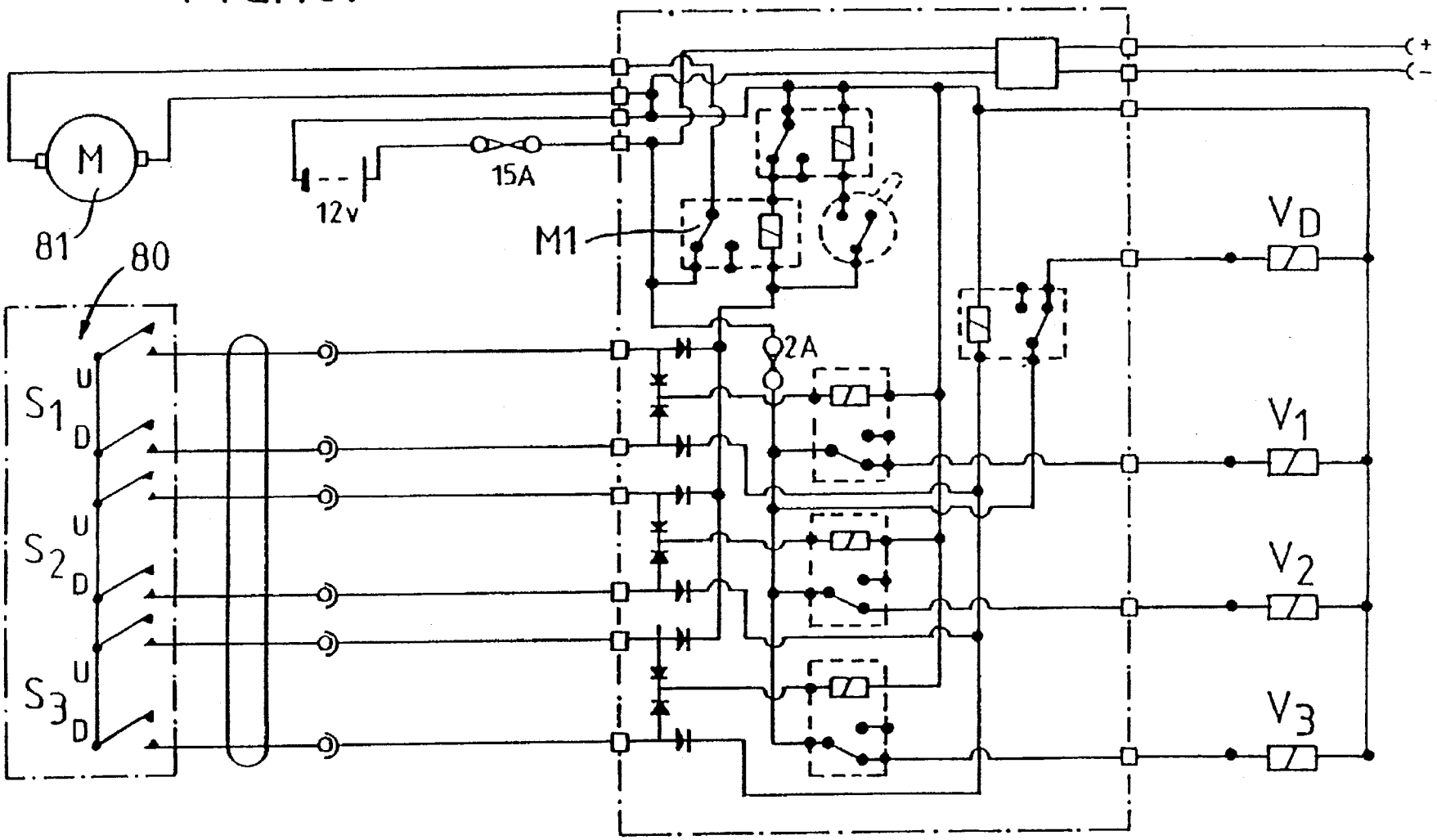
FIG. 16 is a circuit diagram of a compressor and power unit of the wheelchair.
Figure 17:
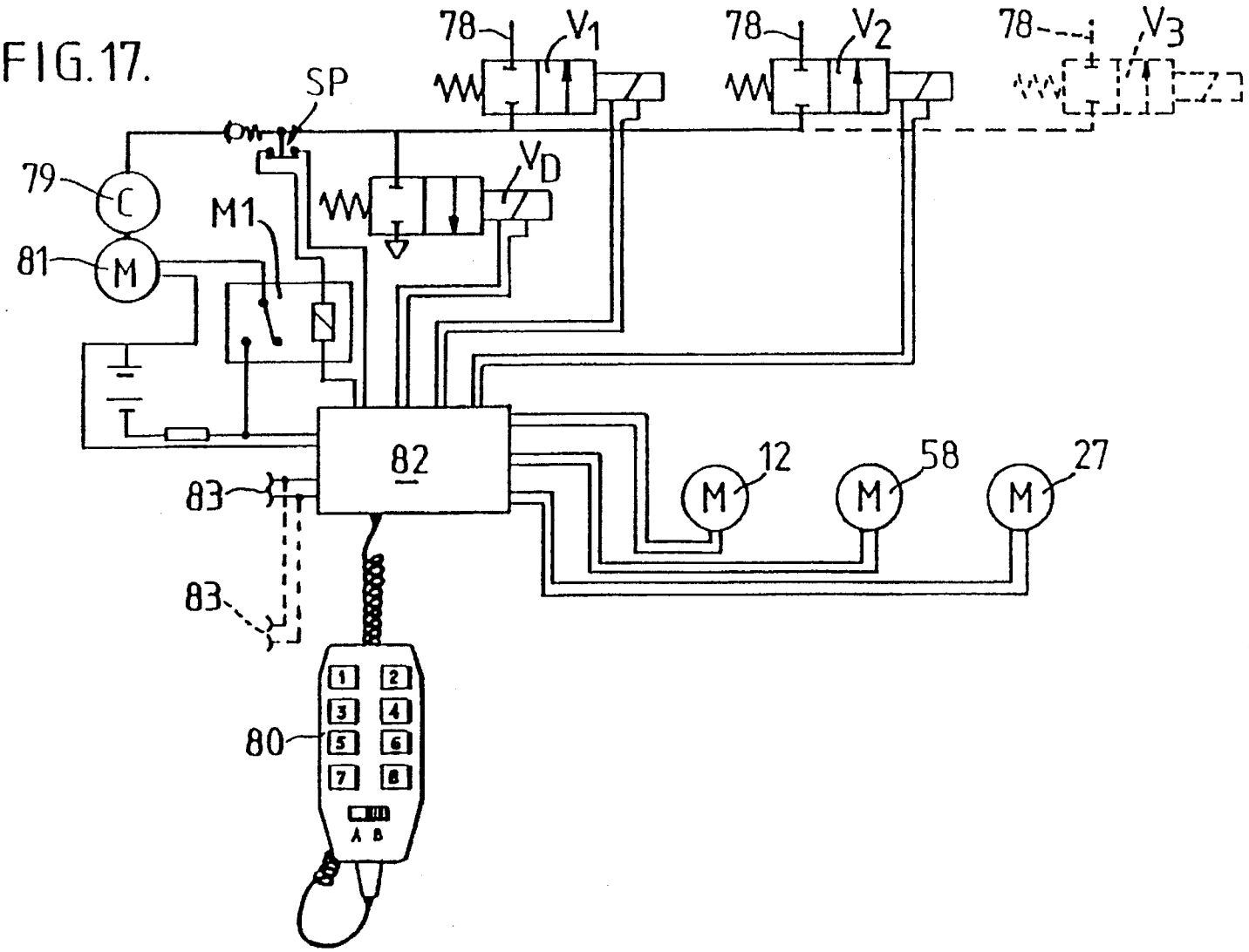
FIG. 17 shows a diagrammatic general arrangement of the control system with some functional parts of the second embodiment.

Referring to FIGS. 16 and 17, the various lifting means 39 and lifting devices 60, 63, the winch motor 12, (optionally also the gear release mechanism), the mast extension motor 58 and the worm motor 27 are controllable by a control system (FIG. 17) including a remote hand control unit 80 and controls (FIGS. 16 and 17) in the compressor and power unit 41.

Figure 7:
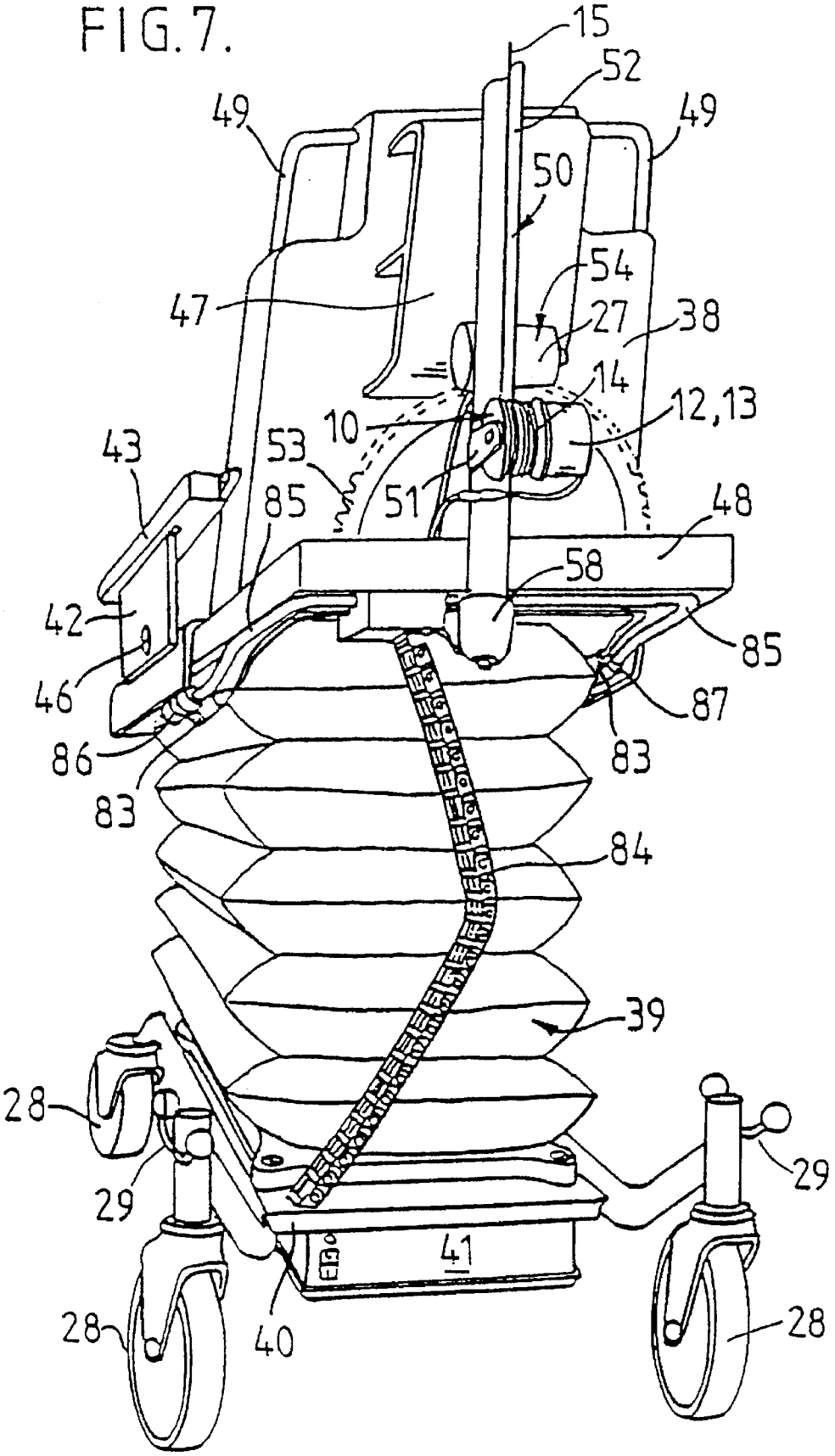
Figure 8:
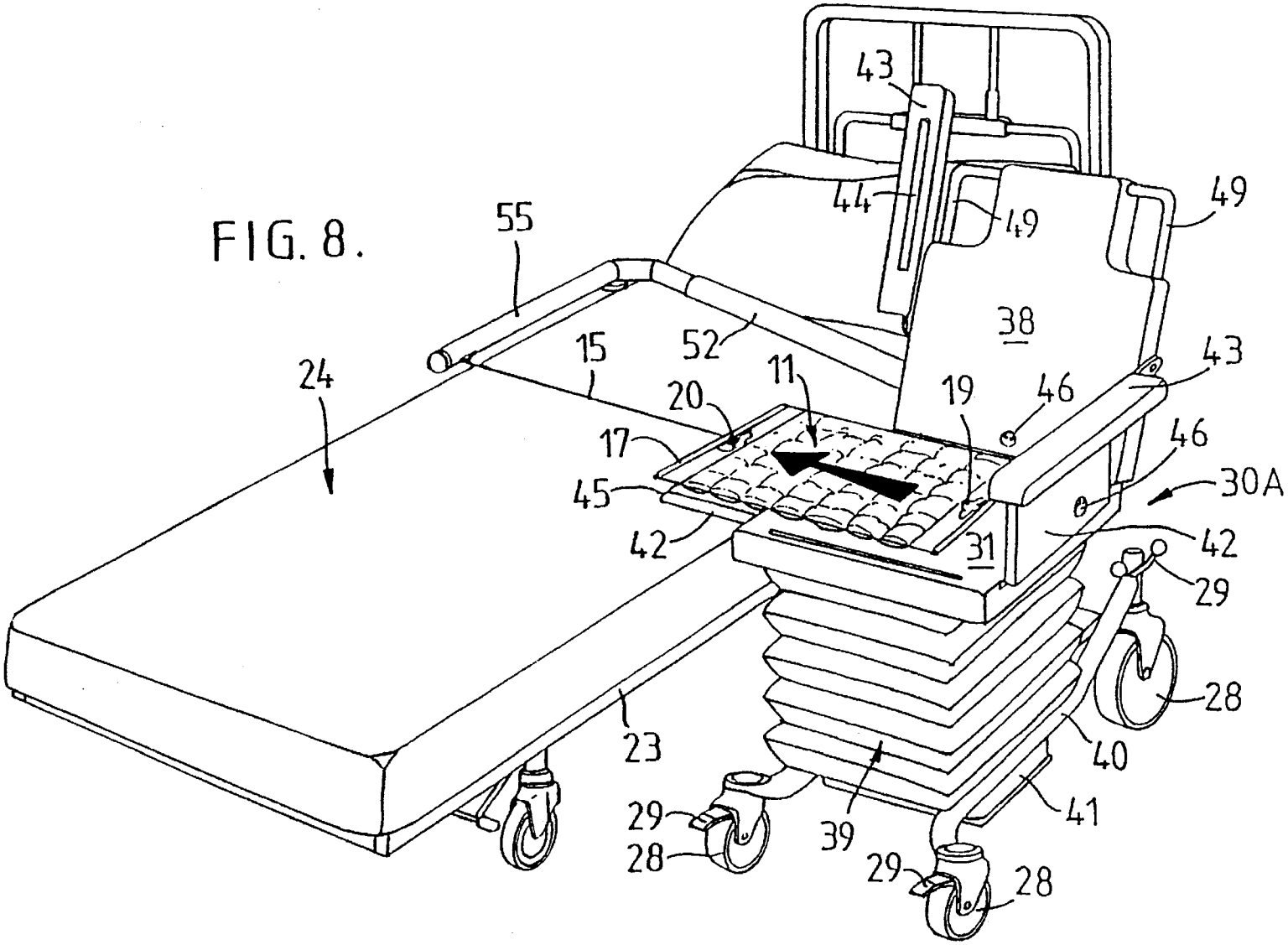
FIGS. 8, 9 and 9A show the arrangement of the second embodiment, without and with an auxiliary leg lifting device, respectively, for use in transferring a person from a wheelchair to a bed.

The unit 41 has at least two, and preferably three independent compressed air outlets 78. One of the outlets is connected by a pipe (not shown) in a flexible guide 84 (FIG. 7 only) to the lifting means 39, and two further outlets are connected by pipes 85 (via the guide 84) to auxiliary compressed air output connectors 86 and 87 under the seat 31 as shown in FIG. 7. Each outlet is controlled by a respective solenoid actuated valve $V_1$, $V_2$ or $V_3$, which valves and a dump or depressurization valve $V_D$ are connected to a common supply line from a compressor 79. In the simplified circuit shown in FIG. 16, each of $V_1$, $V_2$ or $V_3$ is controlled from a respective switch $S_1$, $S_2$ or $S_3$ on the hand unit 80. Each switch has an inflate or "up" position, an "off" position and a deflate or "down" position. In the "up" position the motor 81 driving the compressor is switched on via relay M1 and the respective valve is opened via relays shown in FIG. 16. In the "down" position the switch opens the respective valve and the dump valve $V_D$ but does not energise the motor 81. A safety pressure switch SP isolates the motor 81 if a predetermined safety pressure is exceeded in the common supply line.

Referring to FIG. 17, the unit 41 includes a controller 82 which includes relays (not shown) for controlling the electrical power supply to the winch motor 12, the worm motor 27, and the mast motor 58, as well as the relays shown in FIG. 16, and, if provided, for actuating the winch release mechanism, as well as the relays shown in FIG. 16 for controlling the valves $V_1$, $V_2$, $V_3$ and $V_D$, and circuitry (not shown) for energizing auxiliary electrical outlets 83 (also shown under the seat 31 in FIG. 7).

The hand control unit 80 is shown in more detail in FIG. 17 and comprises several push-button switches numbered 1 to 8 in the figure and a function change switch 84 having stable positions A and B.

The switches control the functions of the apparatus, e.g. as listed in the following table.

| BUTTON NO. | FUNCTION A | FUNCTION B |
|---|---|---|
| 1 | Raise seat | Raise seat |
| 2 | Lower seat | Lower seat |
| 3 | Winch in | Winch in |
| 4 | Winch out | Winch out |
| 5 | Jib extend | Inflate ancillary 1 |
| 6 | Jib retract | Deflate ancillary 1 |
| 7 | Jib left | Inflate ancillary 2 |
| 8 | Jib right | Deflate ancillary 2 |

The "winch out" function either reverses the winch motor or releases the winch to enable cable to be unwound from the drum.

"Ancillary 1" will usually be the device 60 when connected to connector 86, and "Ancillary 2" will usually be the device 63 when connected to connector 87 via the unit 68 and the hose 70 and lead 71.

The invention is not confined to details of the foregoing examples and it includes within its scope mechanical and functional equivalents and variants of the apparatus disclosed. Such variants are encompassed within the scope of the invention.

Figure 18:
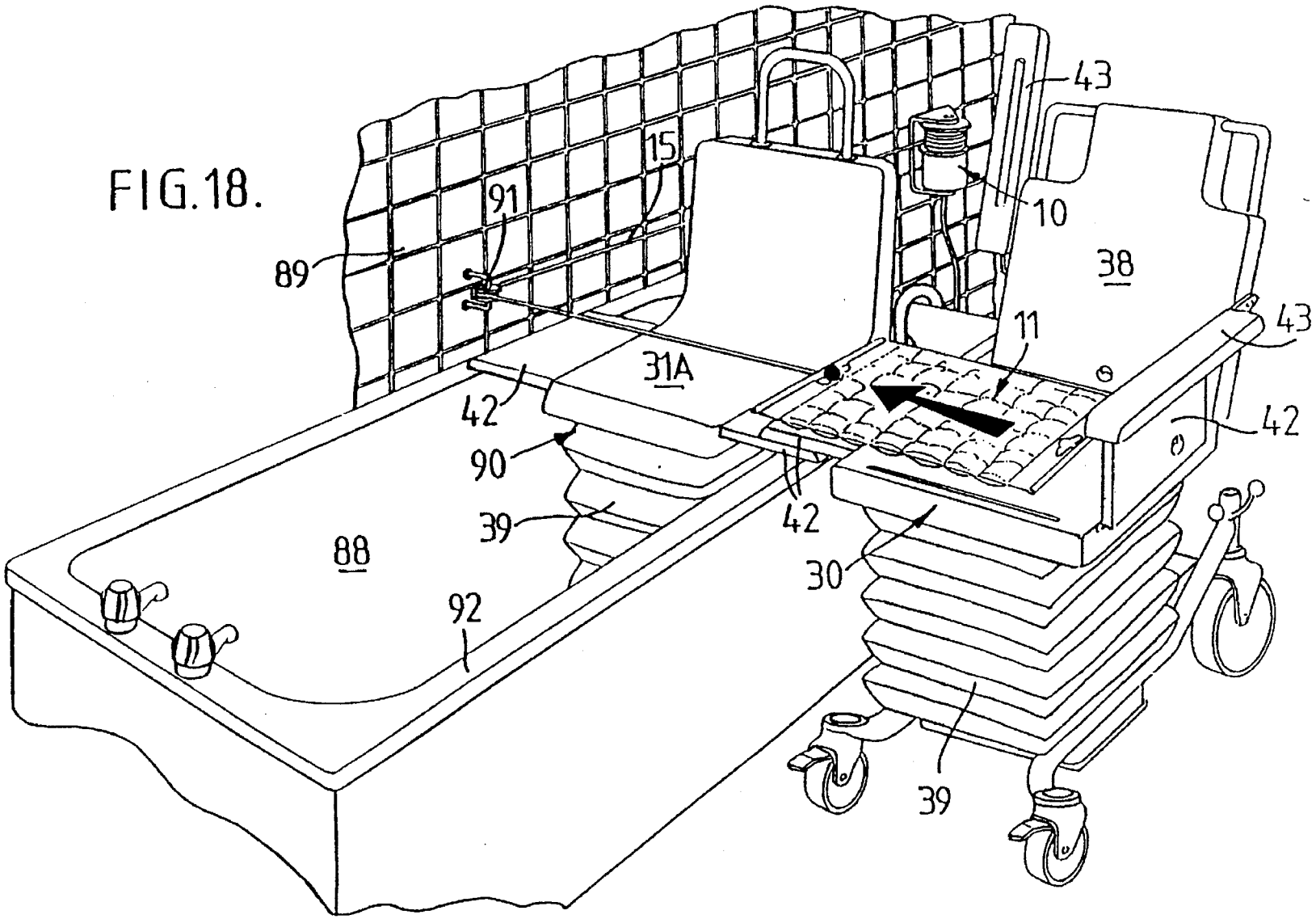
FIG. 18 shows a perspective view of a bath installation incorporating a third embodiment of the apparatus.

For example, the first embodiment may be adapted for use in an installation such as the bath installation shown in FIG. 18, in which a bath 88 is located against a wall 89, and a bathlift 90, comprising the lifting means 39 and a seat 31A with flank panels 42, is located in the bath e.g. by suckers (nor shown) on the base of the lifting means; and in which the cable winch 10 and cable guide 91 are fixed to the wall 89 so that the cable 15 can be run across the seat 31A to draw a person (on the slider 11) from a seat or other support, e.g. the wheelchair 30, onto the seat 31A when the latter is raised to about the level of the brim 92 of the bath so that the flank panels rest thereon. Simplified versions of the units 41 and 80 (not shown in FIG. 18) are employed for controlling the bathlift and winch.

Figure 19:
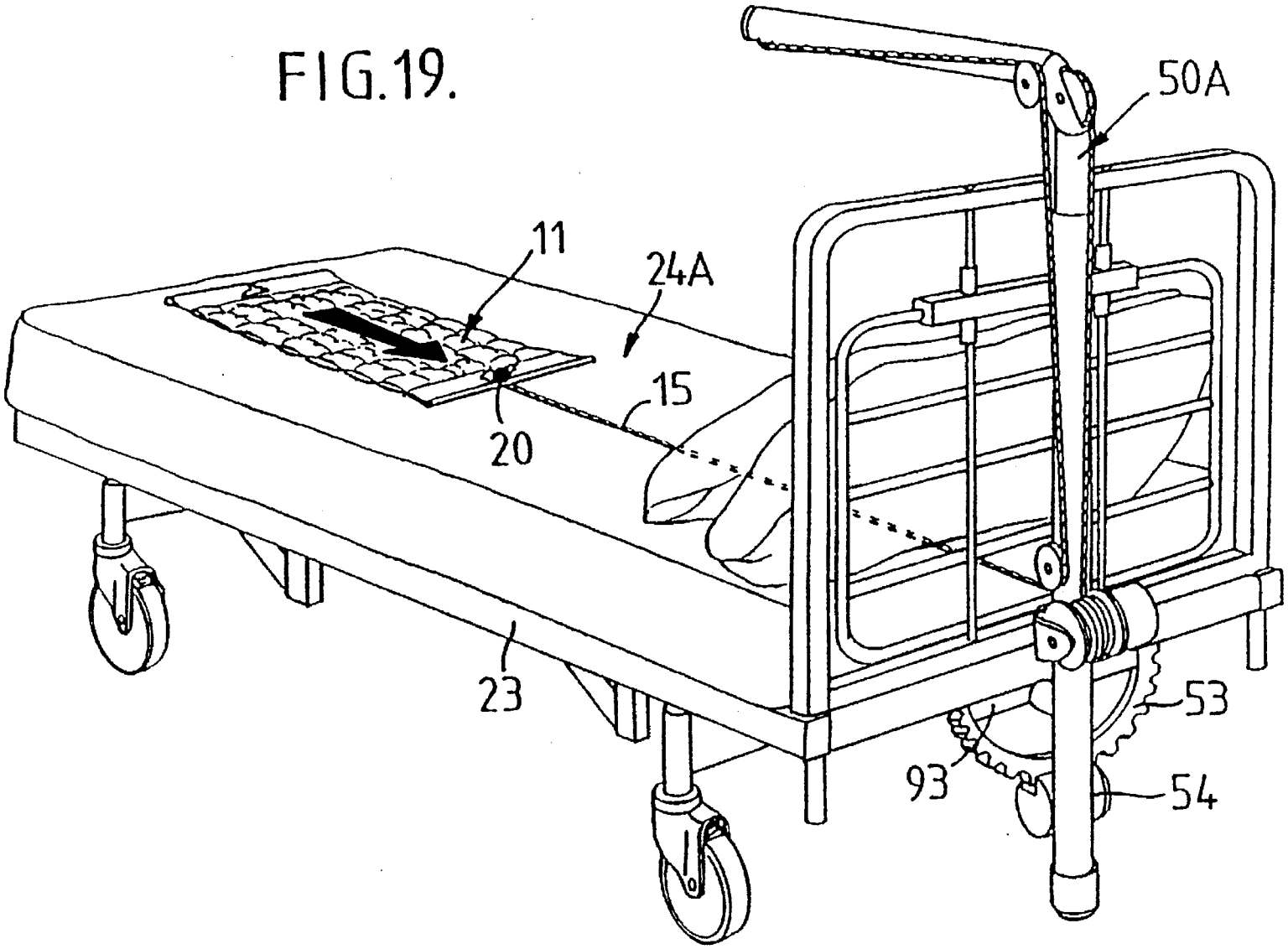
FIG. 19 shows a rear perspective view of a fourth embodiment of the apparatus in the form of a hospital bed.
Figure 20:
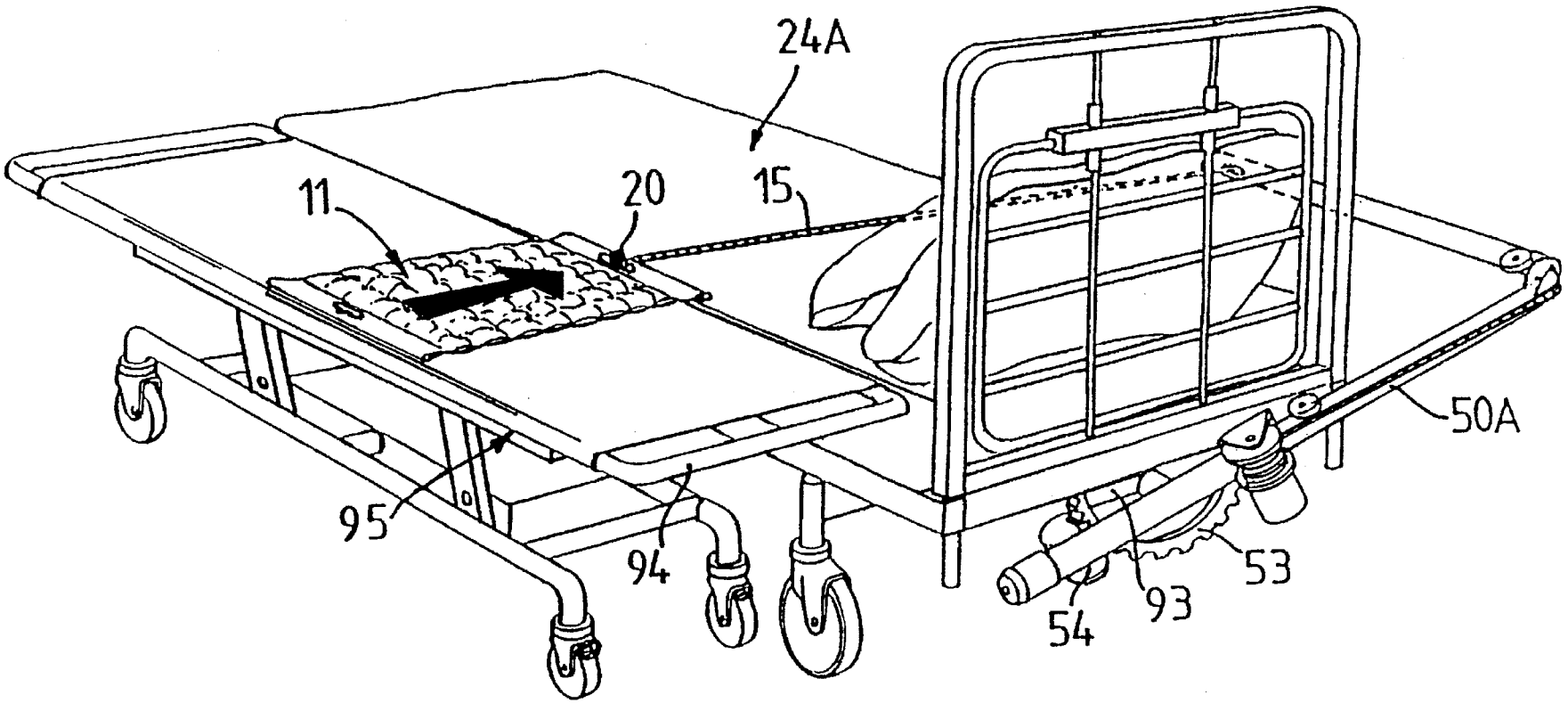
FIG. 20 shows the bed with a trolley alongside for transfer of a person to the bed.

Further, the second embodiment of the apparatus may be adapted for use on a bed or trolley, such as the bed 24A shown in FIGS. 19 and 20, by providing on the bed a mast and jib assembly 50A. In this assembly 50A a mounting 93 is secured to the bed frame 23 to secure (preferably releasably) the assembly to the frame; and for convenience the rack 53 is inverted to extend below the mast pivot axis and the worm 54 is relocated onto a lower extension of the mast 52. The assembly 50A is otherwise similar to form and function to the assembly 50 hereinbefore described.

Figure 21B:
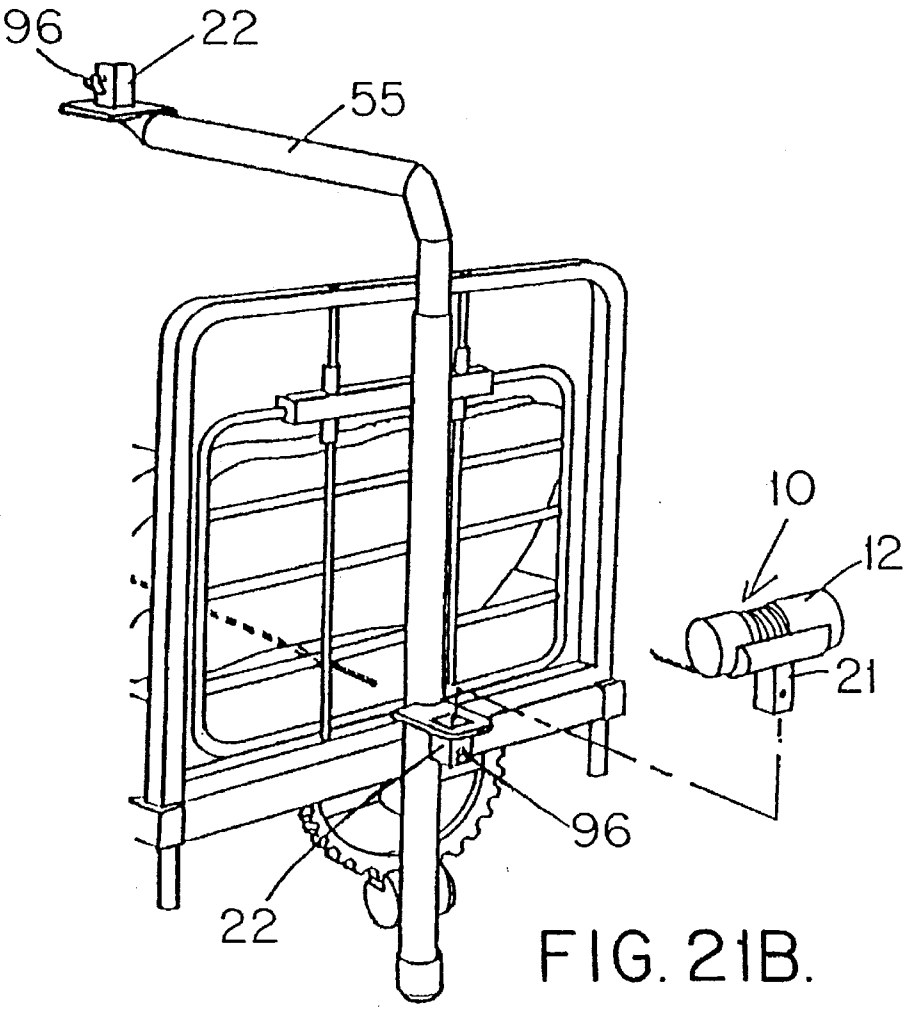
FIGS. 21A and 21B shows modifications of the winch mounting applicable to the second and fourth embodiments.
Figure 21A:
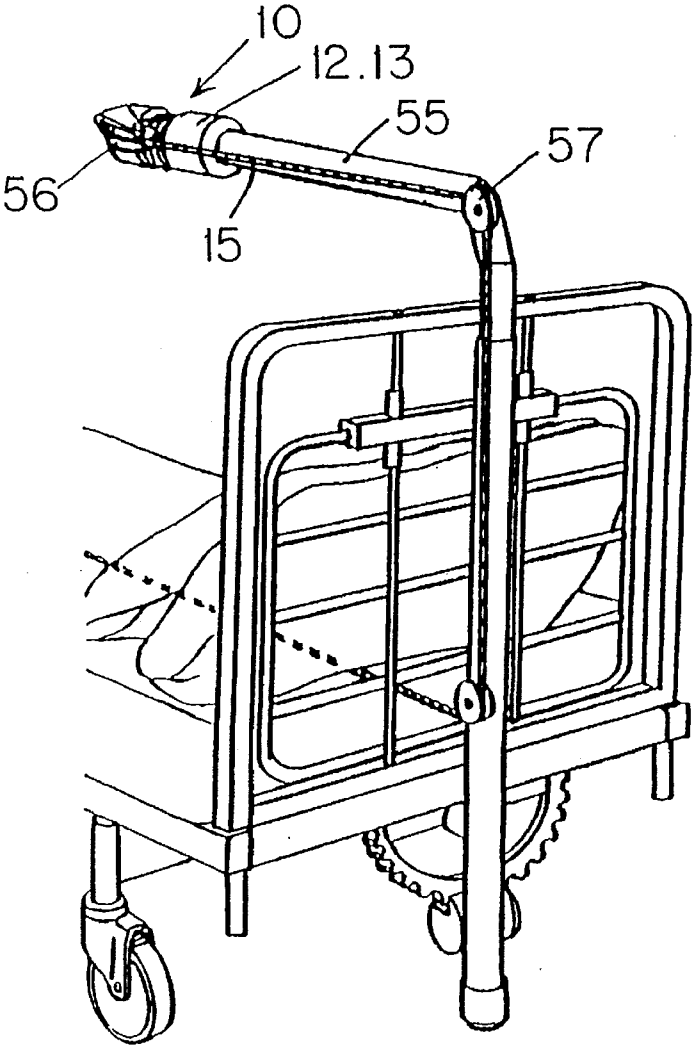

Also, it will be readily appreciated that in the assembly 50A the mast may be, but need not be, telescopically extendable, but it may be advantageous to make the jib telescopically extendable and to provide a motor equivalent to the motor 58 at one end of the jib. Additionally the winch 10 may be located on the jib 55 instead of the mast, e.g. at the free end of the jib as shown in FIG. 21A, the pulleys 56 and 57 of the guide means being retained for relocation of the cable for operation as shown in FIG. 11 and FIG. 19.

It will be readily appreciated that the embodiments described are by way of example only, and that the invention includes and provides apparatus for transferring persons incorporating any suitable combination of parts, equipment and functional means taken selectively from any plurality of the embodiments. For example, the winch which is transferable and relocatable in a plurality of positions as disclosed in the first embodiment may be employed in appropriately modified forms of the second and fourth embodiments, e.g. as shown in FIG. 21B in which the free end of the jib 55 provides a first socket mounting or mounting socket 22 for the winch 10 for use in transverse transfer, and the mast 52 (or the platform, seat, chassis or bed frame) provides an alternative socket mounting or mounting socket 22 for use in longitudinal or rearwards transfer. The socket mountings 22 are preferably provided with fasteners, such as the fasteners 96 shown in FIG. 21B to retain the posts 21 in the socket mountings.

Further, the assembly 50A could be secured to the end frame member 94 of a trolley such as the trolley 95 shown in FIG. 20, instead of to a bed or even a chair or other support.

The terms and expressions used herein are by way of example, and include within their scope equivalents, synonyms and generic terms.

The invention further provides and includes a method or apparatus comprising any novel step, part or feature, or combination thereof disclosed herein or in the accompanying drawings.

I claim:

1. A method of transferring a disabled person from a first supporting surface to a second supporting surface comprising the steps of:

a) providing a pivotally mounted mast assembly on a support on one of said supporting surfaces;

b) positioning said mast assembly on said support so that a winch cable can be extended from the mast assembly towards the edge of the second supporting surface remote from the first supporting surface;

c) locating the winch cable to extend across the second supporting surface to the first supporting surface and inserting a flexible slider between said person and the first supporting surface;

d) connecting said winch cable to one margin of the slider; and e) actuating a winch to apply tension to the winch cable to drag the slider from the first to the second surface carrying said person therewith.

2. Apparatus for moving disabled persons in the form of a wheelchair, said apparatus comprising:

a) seat means for supporting a disabled person;

b) slide means for disposition under the disabled person;

c) powered lifting means for raising and lowering the seat means;

d) a mast assembly pivotally mounted on the seat means;

e) cable winch means mounted on the mast assembly;

f) means to connect a winch cable of the winch means to the slide means; and g) remote control means to selectively energize said lifting means and said winch means for use in drawing a person on the slide means onto the seat means with the cable winch means.

3. Apparatus as claimed in claim 2 wherein the lifting means, winch means and mast assembly are operated from low voltage, rechargeable power means stowed adjacent the apparatus.

4. Apparatus as claimed in claim 3 wherein the lifting means is powered by compressed air from the rechargeable power means.

5. Apparatus as claimed in claim 3 wherein an auxiliary lifting device is pneumatically connected to said rechargeable power means and the auxiliary lifting device, when deflated, is sufficiently flexible and thin to be eased under a disabled person, and provides sufficient lift to raise the uppermost surface of the auxiliary lifting device approximately to the level of the seat means in its lowermost condition.

6. Apparatus as claimed in claim 2 wherein the seat means, mast assembly and jib are provided with cable guide means.

7. Apparatus as claimed in claim 2 wherein a backrest and chassis of the wheelchair provide stowage.

8. Apparatus for moving disabled persons, said apparatus comprising:

a) cable winch means adapted to be secured to a support so that a cable of the winch means can be extended across a platform provided on the support for connection to a slider which can be inserted between a disabled person and a surface on which said person is supported;

b) connector means to releasably connect an end of the slider to the cable so that operation of the winch means drags said slider across said surface and onto said platform to transfer the person from the surface to the platform; and c) said winch means is carried by a mast assembly which is pivotally connected to said support so as to be movable to vary the direction of pull of the cable.

9. Apparatus as claimed in claim 8 wherein the mast assembly comprises a mast and a jib extending from a free end of the mast.

10. Apparatus as claimed in claim 8 wherein the winch means is selectively mounted on any one of the mast, the jib, and the platform.

11. Apparatus as claimed in claim 8 wherein the winch means is electrically driven, remotely controllable, and operated from a low voltage DC supply provided by portable, rechargeable power means.

12. Apparatus as claimed in claim 11 wherein the portable rechargeable power means includes a compressor;

an auxiliary lifting device is pneumatically connectable to said compressor and includes a plurality of pneumatically inflatable bags secured one on top of the other;

each said bag includes internal connection means to limit separation of an upper panel from a lower panel of the bag; and pressure sensitive control means is constructed and arranged to receive a single compressed air supply and to distribute the compressed air sequentially to a plurality of outlets which, in use, are connected to said bags, so that, starting with the lowermost, each bag is inflated in turn to a predetermined pressure and is pneumatically isolated from the supply before inflation of the next above bag commences.

13. An apparatus for transferring a disabled person from a first supporting surface to a second supporting surface, said apparatus comprising:

a) support means for one of said supporting surfaces and mast assembly means pivotally mounted to said support means;

b) flexible slider means having a structural configuration effective to slidably move from one of said supporting surfaces to the other supporting surface while carrying the disabled person;

c) said mast assembly means including winch means having a winch cable which is extendable from the mast assembly means towards an edge of one of the supporting surfaces which supporting surface is remote from the other said supporting surface;

d) said winch cable having an extendable length sufficient to extend across the said one of the supporting surfaces;

e) connecting means for coupling said winch cable to said slider means; and f) means for actuating said winch means to apply tension in an amount sufficient to the winch cable when the cable is coupled to said slider means to drag the flexible slider means from one of the supporting surfaces to the other supporting surface while carrying said person therewith.

14. An apparatus as claimed in claim 13 wherein said mast assembly means is pivotally mounted at one end of said support means and includes a mast member and a jib section mounted on a free end of said mast member to extend towards the other end of the support means, said winch cable is extendable and retractable to and from a free end of the jib section, and said mast assembly means being pivotally movable to swing the jib section from one side of one of the supporting surfaces to the other side of said supporting surface to pull said slider means with said disabled person along a supporting surface.

15. An apparatus as claimed in claim 14 wherein the winch means is removably mounted on said jib section.

16. An apparatus as claimed in claim 15 wherein said jib section is extendable.

17. An apparatus as claimed in claim 14 wherein the winch means is mounted on the mast member and at least the free end of the jib section includes cable guide means.

18. An Apparatus as claimed in claim 17 wherein the mast member is extendable.

19. An apparatus as claimed in claim 13 wherein said support means includes lifting means, and said apparatus further includes remote control means for operating said lifting means, the mast assembly means and said winch means.

20. An apparatus as claimed in claim 13 further includes guide means for guiding the cable is mounted to said support means.

* * * * *